US006668517B2

(12) United States Patent
Hiramoto et al.

(10) Patent No.: US 6,668,517 B2
(45) Date of Patent: Dec. 30, 2003

(54) SPOUT TRANSFER METHOD, SPOUT TRANSFER APPARATUS AND SPOUT POSITIONING AND SUPPLYING APPARATUS

(75) Inventors: Shinichi Hiramoto, Iwakuni (JP); Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 64 days.

(21) Appl. No.: 09/882,543

(22) Filed: Jun. 15, 2001

(65) Prior Publication Data

US 2001/0052216 A1 Dec. 20, 2001

(30) Foreign Application Priority Data

Jun. 15, 2000 (JP) ..... 2000-180634

(51) Int. Cl.[7] ..... B65B 61/18

(52) U.S. Cl. ..... 53/133.2; 53/133.1; 53/284; 53/284.7; 53/287; 53/300; 53/308; 53/313; 493/213; 198/470.1; 198/803.3

(58) Field of Search ..... 53/133.1, 133.2, 53/284, 284.7, 287, 300, 308, 313; 198/470.1, 471.1, 803.3, 803.7; 53/410; 493/213

(56) References Cited

U.S. PATENT DOCUMENTS 3,948,711 A 4/1976 Piatek
3,975,888 A * 8/1976 Jones ..... 53/386.1
5,219,320 A * 6/1993 Abrams et al. ..... 493/8
5,429,699 A * 7/1995 Abrams et al. ..... 156/252
5,581,975 A * 12/1996 Trebbi et al. ..... 53/284.6
6,085,489 A * 7/2000 Bachner et al. ..... 53/410
6,321,813 B1 * 11/2001 Miyajima et al. ..... 156/497

FOREIGN PATENT DOCUMENTS

| | | |
|---|---|---|
| JP | H10-202768 | 8/1998 |
| JP | H11-124228 | 5/1999 |
| JP | H11-208884 | 8/1999 |
| JP | H2000-062050 | 2/2000 |

* cited by examiner

*Primary Examiner*—Rinaldi I. Rada
*Assistant Examiner*—Gloria R Weeks
(74) *Attorney, Agent, or Firm*—Koda & Androlia

(57) ABSTRACT

With a use of a transfer rotor that has gripping claws on its circumference, spouts are received by the gripping claws and conveyed and transferred to spout holding members of a continuously rotating rotor. The transfer rotor rotates intermittently 60° in a cycle consisting of stopping, acceleration, constant speed, deceleration and stopping. When the transfer rotor is stopped, spouts are received by gripping claws. During the constant rotation, the gripping claws are matched with the speed of the spout holding members, and the gripping claws and the spout holding members run side by side. During this side-by-side running, the spouts are transferred from the gripping claws to the spout holding members. At a transfer position, the gripping claws open, and the spouts move along a guide member as the spout holding members rotate, so that the spouts are pushed into the interiors of holding grooves of the spout holding members.

10 Claims, 20 Drawing Sheets

SPOUT TRANSFER METHOD, SPOUT TRANSFER APPARATUS AND SPOUT POSITIONING AND SUPPLYING APPARATUS

BACKGROUND OF THE INVENTION

1. Field of the Invention

The present invention relates to a spout transfer method and apparatus in which spouts positioned in a specified position are received and transferred to a plurality of spout holding members that are disposed on the circumference of a continuously rotating rotor and further relates to a spout positioning and supplying apparatus which positions and supplies spouts to the transfer apparatus.

2. Prior Art

Japanese Patent Application Kokai (Laid-Open) Nos. H11-208884, H11-124228 and 2000-62050, for instance, disclose rotary type spout transfer apparatuses. In these rotary type spout transfer apparatuses, a plurality of spout transfer means are disposed on the circumference of a continuously rotating rotor, spouts that are in a substantially stationary state in a specified position are held and conveyed by the spout transfer means, and the spouts are transferred to the spout holding means of an adjacent continuously rotating working rotor.

In particular, in Japanese Patent Application Kokai (Laid-Open) No. H11-208884, a transfer apparatus in which a plurality of clamping means are disposed on the circumference of a continuously rotating rotor is disposed between a parts feeder and a spout-equipped container manufacturing apparatus, spouts positioned in a receiving position at the exit point of these parts feeder are received by the clamping means, and the spouts are transferred to dampers disposed on the circumference of the continuously rotating rotor of a spout-equipped container manufacturing apparatus.

Furthermore, in Japanese Patent Application Kokai (Laid-Open) No. H11-124228, a transfer apparatus in which a plurality of neck-retaining levers are disposed on the circumference of a continuously rotating rotor is disposed between a conveying trough and a rotary filling machine, spout-equipped containers which are pushed out from the exit point of the conveying trough are received between the neck-retaining levers and the suspension stage of the rotor, and the spout-equipped containers are transferred to fingers disposed on the circumference of the continuously rotating rotor of the filling machine.

In Japanese Patent Application Kokai (Laid-Open) No. 2000-62050, a transfer apparatus in which a plurality of supply arms are disposed on the circumference of a continuously rotating rotor is disposed between the feeder part of a vibrating feeder and a rotary apparatus (spout-equipped container manufacturing apparatus), spouts are received from the feeder part by the supply arms, and the spouts are transferred to clamping members disposed on the circumference of the continuously rotating rotor of the above-described rotary apparatus.

In the above-described prior art transfer apparatuses, spout transfer means are disposed on the circumference of a continuously rotating rotor, and the spout transfer means receive spouts that are in a stationary state while the spout transfer means are moving, and the spouts are then transferred to the spout holding means of a working rotor that rotates continuously in synchronization with the spout transfer means. However, in the receiving process, it is generally necessary that the spout transfer means receive the spouts at the instant that the spout transfer means arrive at the spout position. Consequently, in cases where the processing speed (units/minute) of the transfer operation is increased, the receiving process abruptly becomes unstable, so that receiving errors (failure to receive, positional deviation, etc.) occur in large numbers. Accordingly, in spite of the fact that the transfer apparatuses (apparatuses in which spout transfer means are disposed on the circumference of a continuously rotating rotor) are used for the purpose of high-speed transfer processing, stable high-speed processing cannot be achieved.

SUMMARY OF THE INVENTION

Accordingly, the present invention is to solve the above-described problems, and the object of the present invention is to allow stable high-speed processing in a spout transfer operation.

The spout transfer method of the present invention is characterized in that the method uses a transfer rotor that has a plurality of spout transfer means disposed on its circumference, wherein the transfer rotor receives spouts using the spout transfer means and conveys the spouts and transfers the spouts to a plurality of spout holding members disposed on a circumference of a continuously rotating rotor, and in which:

- the transfer rotor is rotated intermittently by a specified angle at a time in a cycle that comprises stopping, acceleration, constant speed, deceleration and stopping,
- the spout transfer means receives, when the transfer rotor is stopped, the spouts positioned in a specified position,
- during a period of the constant-speed rotation the spout transfer means are rotated at a speed that matches a speed of the spout holding members, and both of the spout transfer means and the spout holding members are caused to run side by side, and
- during this period the spouts are transferred from the spout transfer means to the spout holding members.

Furthermore, the spout transfer apparatus of the present invention receives spouts positioned in a specified position, conveys the spouts and transfers the spouts to a plurality of spout holding members which are disposed on a circumference of a continuously rotating working rotor, the spout transfer apparatus is characterized in that it comprises:

- a transfer rotor which has a plurality of spout transfer means disposed on a circumference thereof, and
- a driving means which causes the transfer rotor to rotate intermittently by a specified angle at a time in a cycle that comprises stopping, acceleration, constant speed, deceleration and stopping, so that the driving means causes the spout transfer means, during the period of constant-speed rotation, to match a speed of the spout holding members and causes the spout transfer means and the spout holding members to run side by side, during the period of constant-speed rotation; and wherein:
- the spout transfer means receive positioned spouts when the transfer rotor is stopped, and
- the spout transfer means transfers the spouts to the spout holding members during the period of constant-speed rotation.

This spout transfer apparatus is installed adjacent to, for instance, a spout insertion and temporary-sealing apparatus. The spout insertion and temporary-sealing apparatus comprises a plurality of spout holding members disposed on a circumference of a continuously rotating rotor and bag holding-and-insertion means that correspond to the respective spout holding members, and it opens the bags held by the bag holding-and-insertion means, fits the bags over spouts held by the spout holding members, and then temporarily seals the bags and spouts.

The spout holding members are, for instance, fork-shaped members which have clamping grooves that are oriented outward in a radial direction so as to hold groove portions located between flanges of the spouts, and tapered surfaces that open outward are formed in a vicinity of an entry point of the clamping groove.

Furthermore, it is desirable that a spout transfer means of the spout transfer apparatus have gripping sections that open and close, and head portions of the spouts are gripped by the gripping sections. The gripping sections open and close, for instance, in a vertical plane that is parallel to the radial direction of the transfer rotor.

In a case where the spout holding members have the above-described structure, it is possible that a conveying track of centers of spout holding positions of the spout transfer means and a conveying track of centers of the spout holding positions of the spout holding members are set to be close to each other, and the transfer rotor is rotated at a constant speed in a vicinity of a position of closest proximity of the two conveying tracks, so that the spouts held by the spout transfer means are introduced into clamping grooves of the spout holding members while the transfer rotor is rotating at the constant speed. In order to push the spouts even further into the centers of the spout holding positions of the spout holding members, a push-in guide member is provided. The push-in guide member has a guide surface that contacts spouts introduced into the clamping grooves and guides the spouts from the conveying track of centers of the spout holding positions of the spout transfer means toward the conveying track of centers of the spout holding positions of the spout holding members.

In regard to the transfer apparatus that is installed adjacent to the spout insertion and temporary-sealing apparatus, when a timing is set in the transfer apparatus so that spouts that correspond to bags supplied to the holding-and-insertion means of the spout insertion and temporary-sealing apparatus are received after the bags have been supplied, a detection device which detects faulty supply of bags to the holding-and-insertion means is provided, and a regulating means which stops receiving of corresponding spouts by the spout transfer means based upon a detection signal of the detection device is provided.

Likewise, when a timing is set in the transfer apparatus so that spouts that correspond to bags opened by the holding-and-insertion means of the spout insertion and temporary-sealing apparatus are received after the bags have been opened, a detection device which detects faulty opening of bags by the holding-and-insertion means is provided, and a regulating means which stops receiving of corresponding spouts by the spout transfer means based upon a detection signal of the detection device is also provided.

The present invention further provides a spout positioning and supplying apparatus that supplies spouts to the spout transfer apparatus. This spout positioning and supplying apparatus is comprised of:

spout supply rails which support bottoms of flange portion of spouts from both sides and guide the spouts into a single row, a feed-in means disposed near an exit of the spout supply rails, the feed-in means driving the spouts on the spout supply rails toward the exit and advancing the spouts in a state of tight contact with each other, an opening-and-closing stopper disposed at the exit of the spout supply rails so as to contact an leading spout and position the leading spout, and a separating stopper that engages with a second spout and stops an advance of the second spout when the opening-and-closing stopper is opened, and releases the engagement with the second spout when the opening-and-closing stopper is closed.

DETAILED DESCRIPTION OF THE INVENTION

Below, the transfer apparatus of the present invention will be concretely described with reference to FIGS. 1 through 17.

Figure 1:
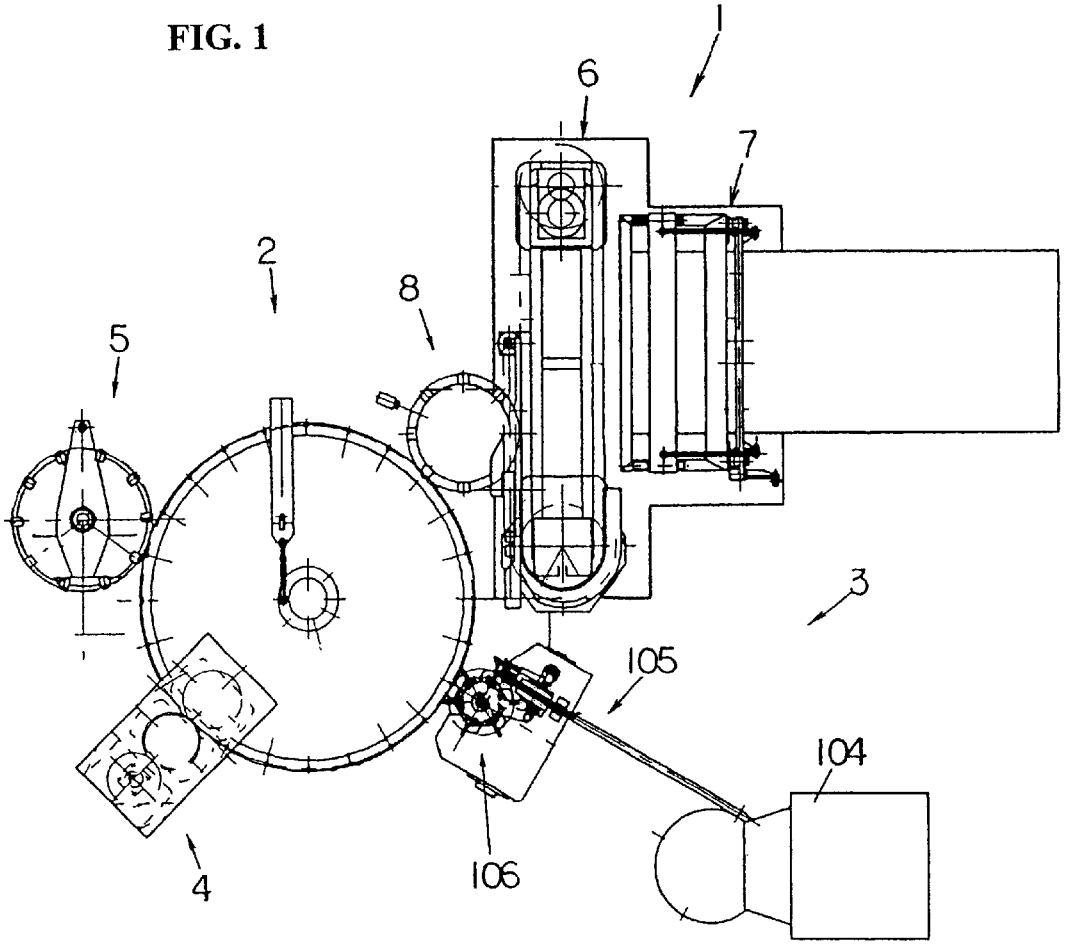
FIG. 1 is a schematic top view of the spout insertion and temporary-sealing apparatus and peripheral devices in the present invention.
Figure 2A:
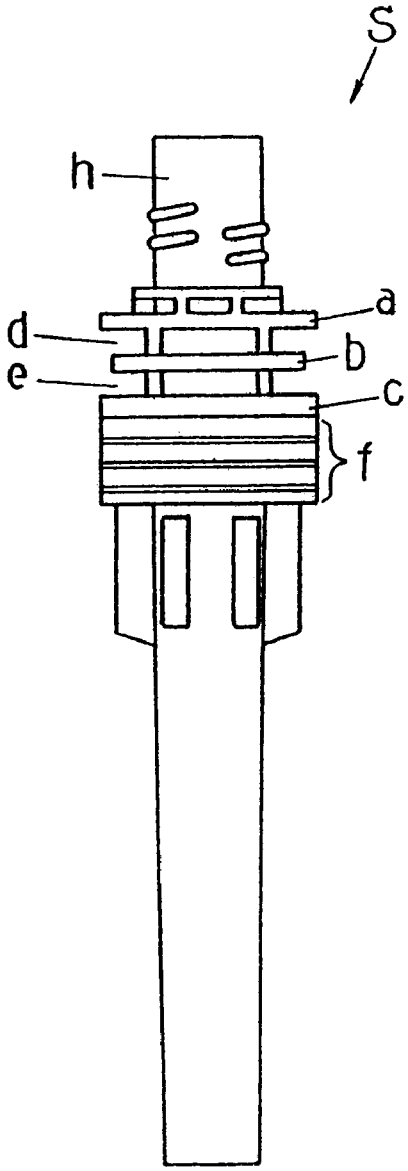
FIG. 2A is a front view of one of the spouts.
Figure 2B:
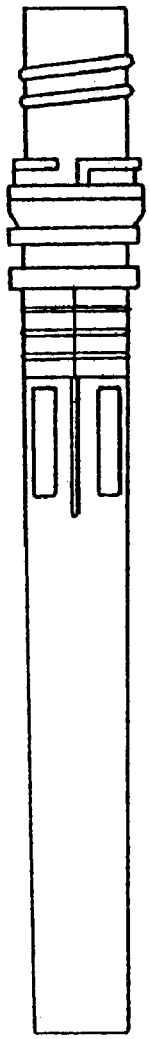
FIG. 2B is a side view thereof.

FIG. 1 is a top view of the spout insertion and temporary-sealing apparatus and associated apparatus. Bags are supplied to the spout insertion and temporary-sealing apparatus 2 from a continuous bag supply device 1, and spouts S (see FIG. 2) are supplied to the spout insertion and temporary-sealing apparatus 2 from a spout supply device 3. Inside the spout insertion and temporary-sealing apparatus 2, bags are fitted over the spouts (i.e., spouts are inserted into the bags), and the sealing portions are temporarily sealed by a temporary-sealing apparatus 4, so that the bags and spouts are connected; then, the bags with spouts attached are transferred to a main-sealing apparatus (not shown) via an intermediate rotor 5. Furthermore, in the spouts S, a, b and c are flange portion, and one of the grooves parts d and e between the flange portion is clamped by the corresponding spout holding member 26 (described later). The groove parts d and e are both formed by flat surfaces. Furthermore, f indicates sealing portions.

The continuous bag supply device 1 may be the same as the continuous bag supply device described in the U.S. patent application Ser. No. 09/523,856 filed by the applicant of the present application. The continuous bag supply device 1 comprises a bag conveying device 6, bag supply devices 7 and a transfer device 8. Of these parts, the bag conveying device 6 conveys a plurality of bag holding members disposed at equal intervals in one direction along an annular track that has a pair of parallel sections; in this case, on one side of the parallel sections, the bag holding members are conveyed intermittently, with each conveying motion being performed for a distance that is an integral multiple of the attachment spacing of the bag holding members, while on the other side of the parallel sections, the bag holding members are continuously conveyed at a constant speed. A plurality of bag supply devices 7 are disposed side by side in a row on the upstream side of the bag conveying device 6 (on one side of the parallel sections), so that a plurality of bags are simultaneously supplied to the bag holding members in an intermittent action. The transfer device 8 is disposed on the downstream side of the bag conveying device (on the other side of the parallel sections); this transfer device 8 continuously receives bags from the bag holding members, and continuously supplies the bags to the bag holding means (holding members and bag bottom receiving stands described later) of the spout insertion and temporary-sealing apparatus 2. Furthermore, a universally known continuous bag supply device other than the continuous bag supply device 1 may also be used in order to supply bags to the bag holding means of the spout insertion and temporary-sealing apparatus 2 in a continuous manner.

Figure 3:
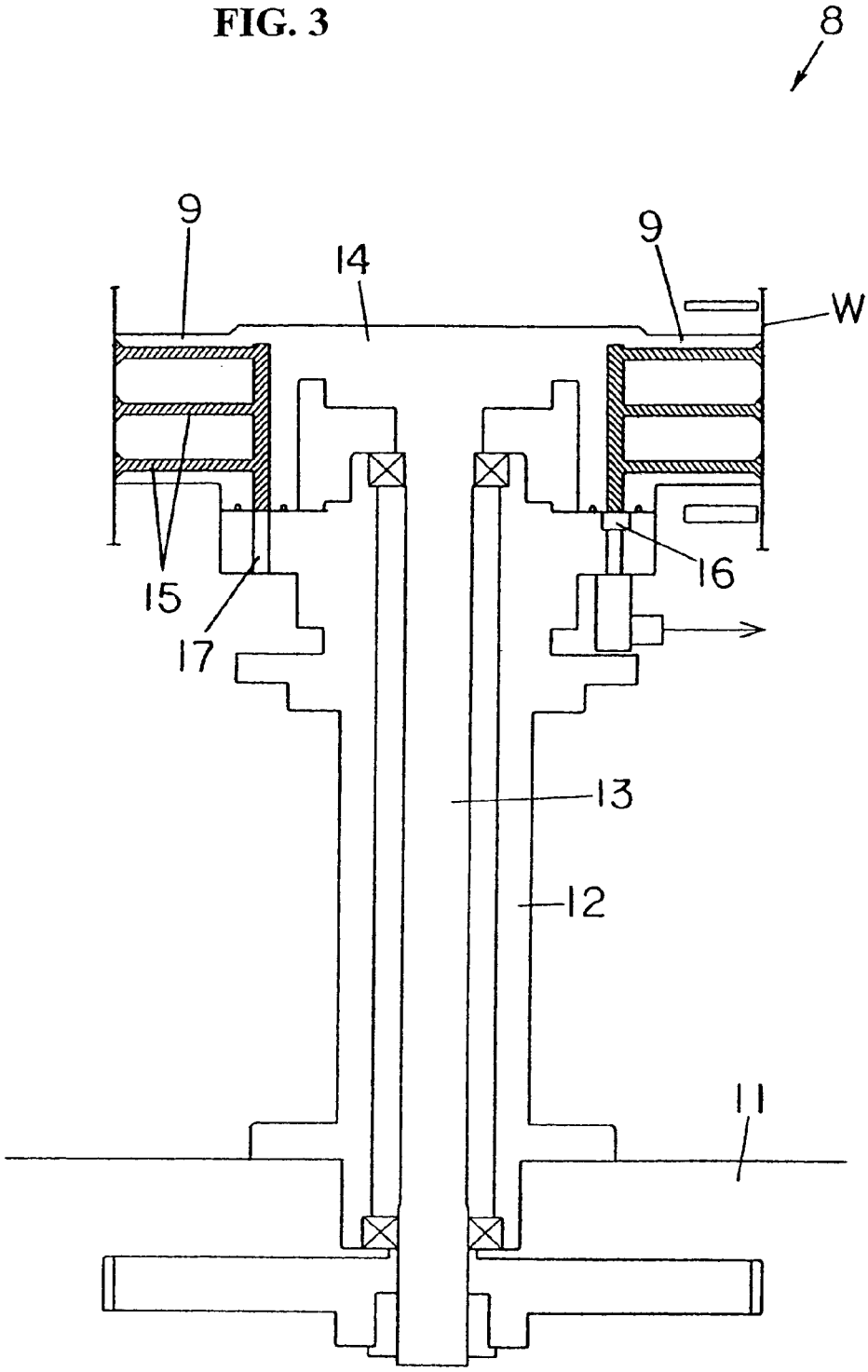
FIG. 3 is a sectional view of the bag transfer device.

Here, among these parts of the continuous bag supply device 1, only the transfer device 8 which has a direct relationship with the spout insertion and temporary-sealing apparatus 2 will be described. As shown in FIG. 3, this transfer device 8 is a rotary type transfer device which has a plurality of transfer means 9 disposed at equal intervals (intervals that are the same as the attachment intervals of the bag holding members of the bag conveying device 6) on its outer circumference. The transfer device 8 is equipped with a supporting stand 12 which is installed in an upright position on a base 11, and a rotor 13 which is caused to rotate continuously by a driving motor (servo motor) not shown. Transfer means 9 that chuck the bags W by means of vacuum suction are formed in the circumferential surface of the rotor head 14, and vacuum passages 15 formed in the rotor head 14 open in the side surfaces of the transfer means 9. From the position facing the bag conveying device 6 to a position in which the vacuum passages 15 have completed approximately ⅝ of a revolution, the vacuum passages 15 are connected to a vacuum pump (not shown) via vacuum ports formed in the supporting stand 12; in a position in which the vacuum passages 15 have completed approximately ⅝ of a revolution, the vacuum passages 15 are connected to an atmosphere release port 17.

The transfer means 9 of the transfer device 8 rotate in the horizontal plane at the same speed and with the same timing as the bags W that are continuously conveyed along the other side of the parallel sections of the bag conveying device 6. The transfer means 9 chuck the bags W and continuously receive the bags W; then, when ⅝ of a revolution has been completed, the transfer means 9 transfer the bags W to the spout insertion and temporary-sealing apparatus 2.

Figure 4:
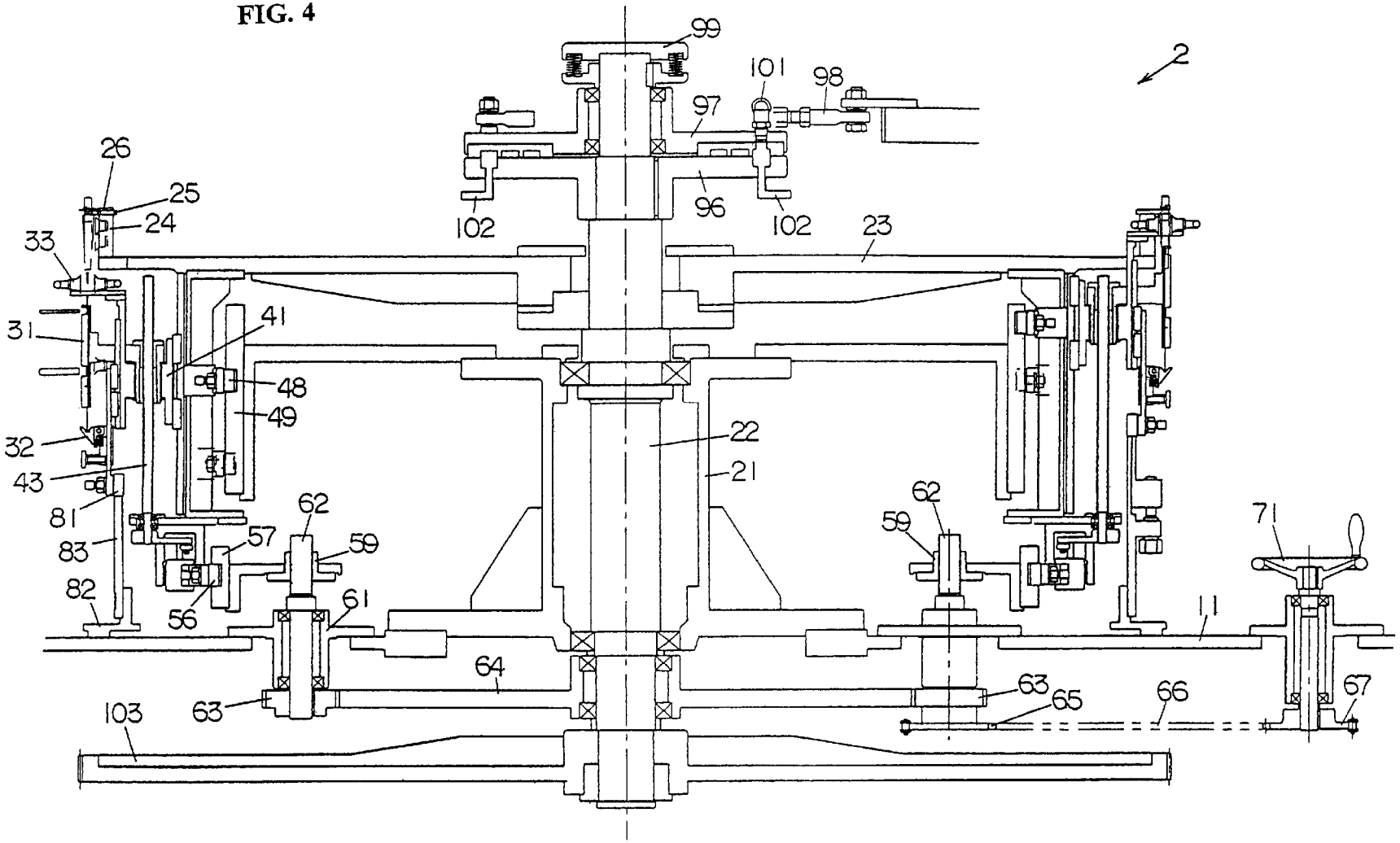
FIG. 4 is a sectional view of the spout insertion and temporary-sealing apparatus.
Figure 5:
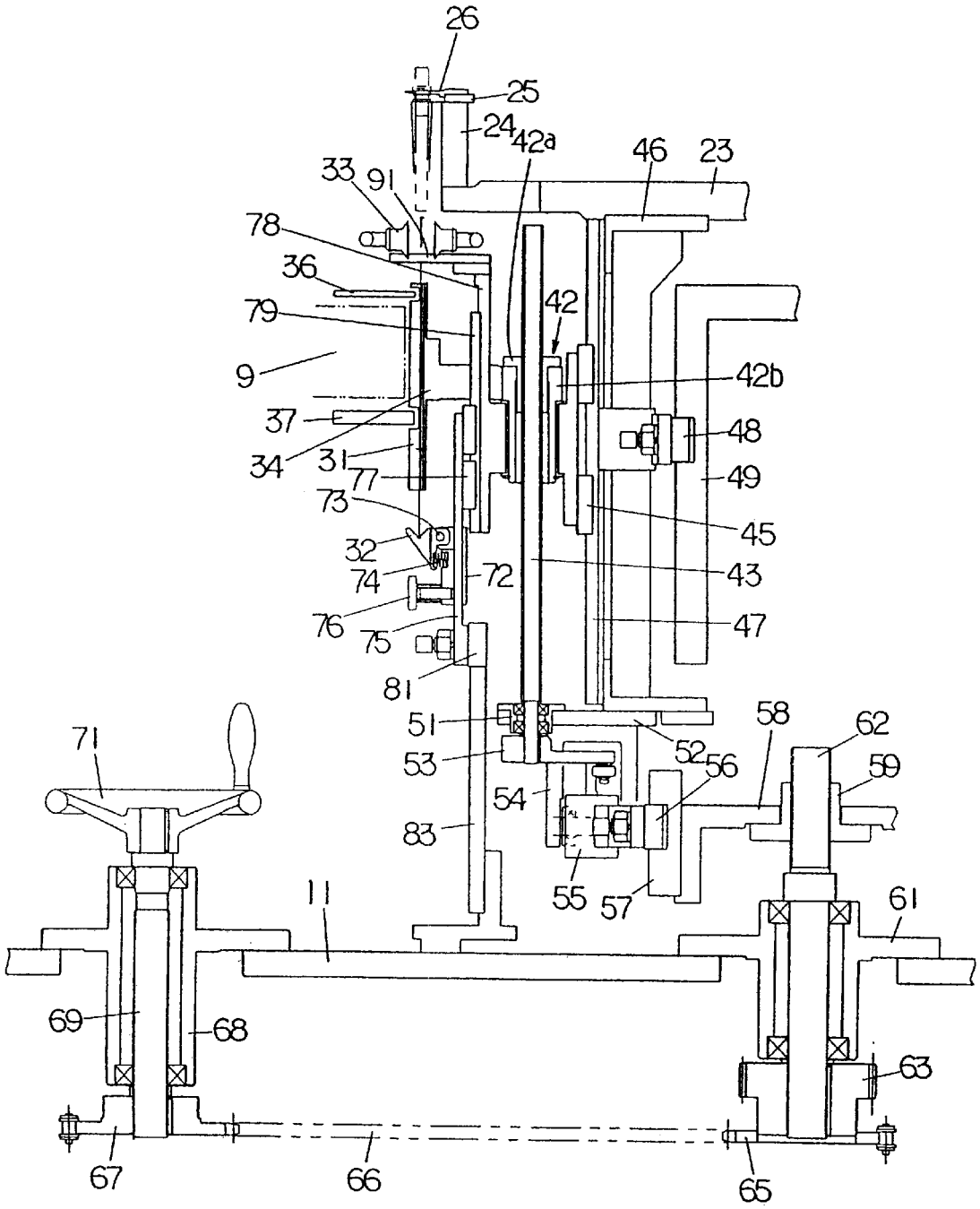
FIG. 5 is an enlarged sectional view of the spout insertion and temporary-sealing apparatus.
Figure 6B:
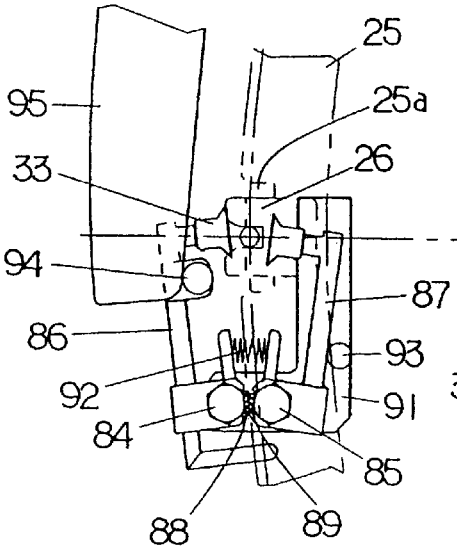
FIG. 6B is a partial top view of the opening-and-closing mechanism of the suction plates.
Figure 6A:
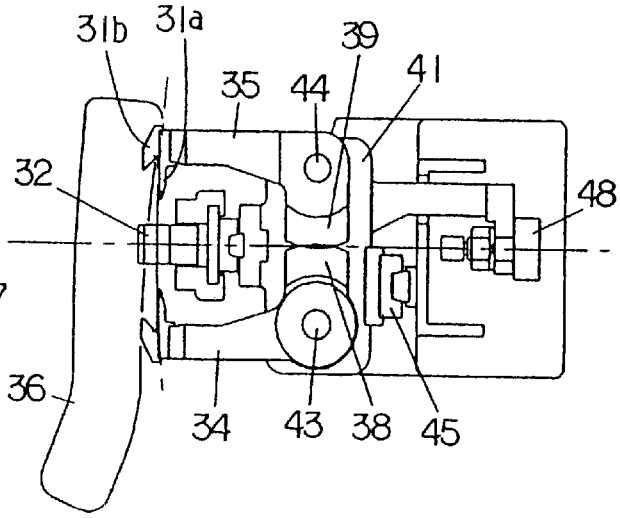
FIG. 6A is a partial top view of the opening-and-closing mechanism of the holding members.
Figure 7A:
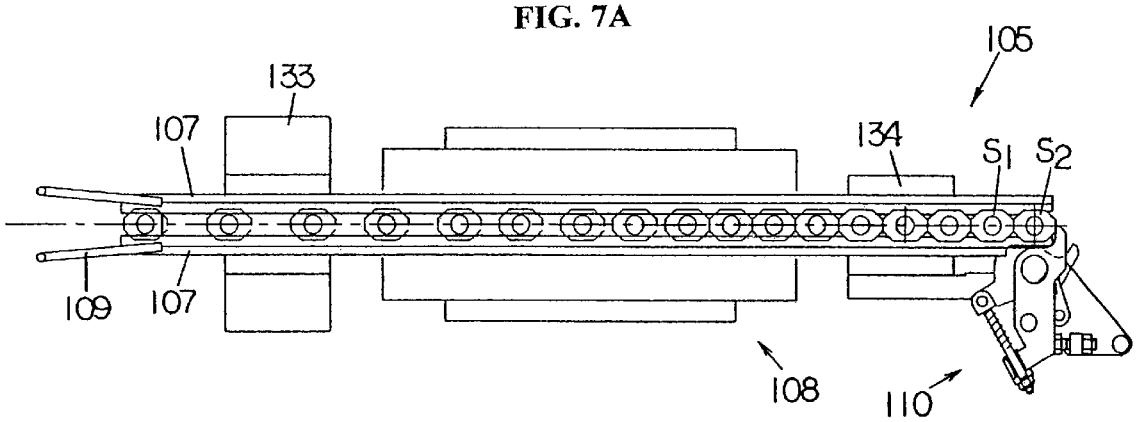
FIG. 7A is a top view of the spout positioning and supplying device.
Figure 7B:
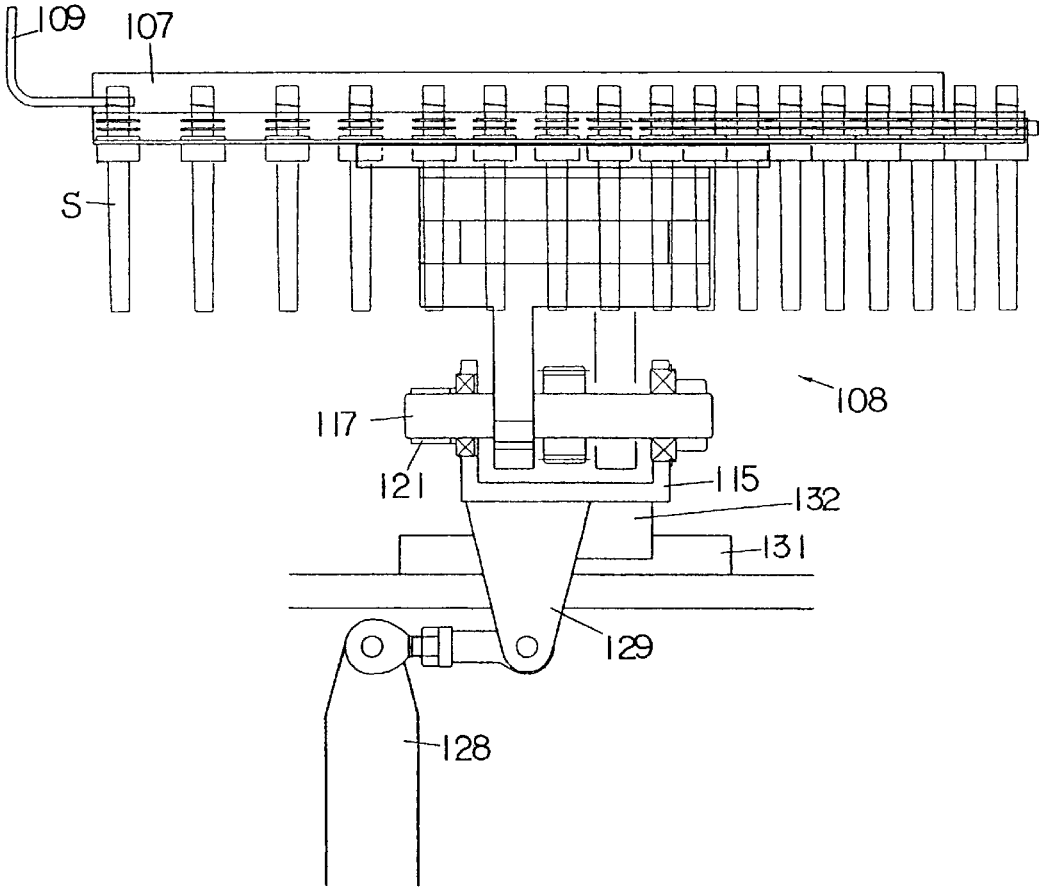
FIG. 7B is a side view thereof.
Figure 8:
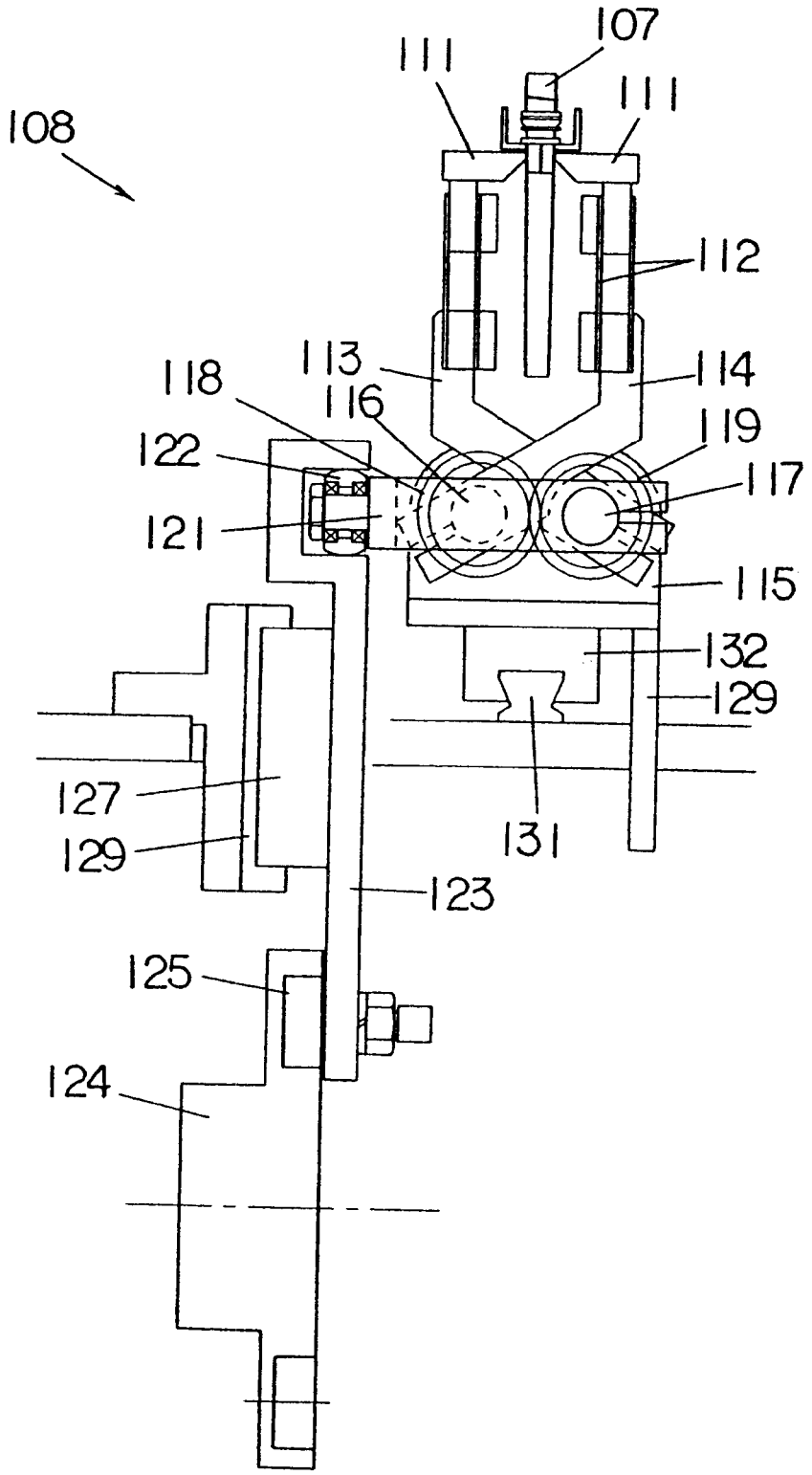
FIG. 8 is a front view of the spout force-feeding device in the spout positioning and supplying device.
Figure 9:
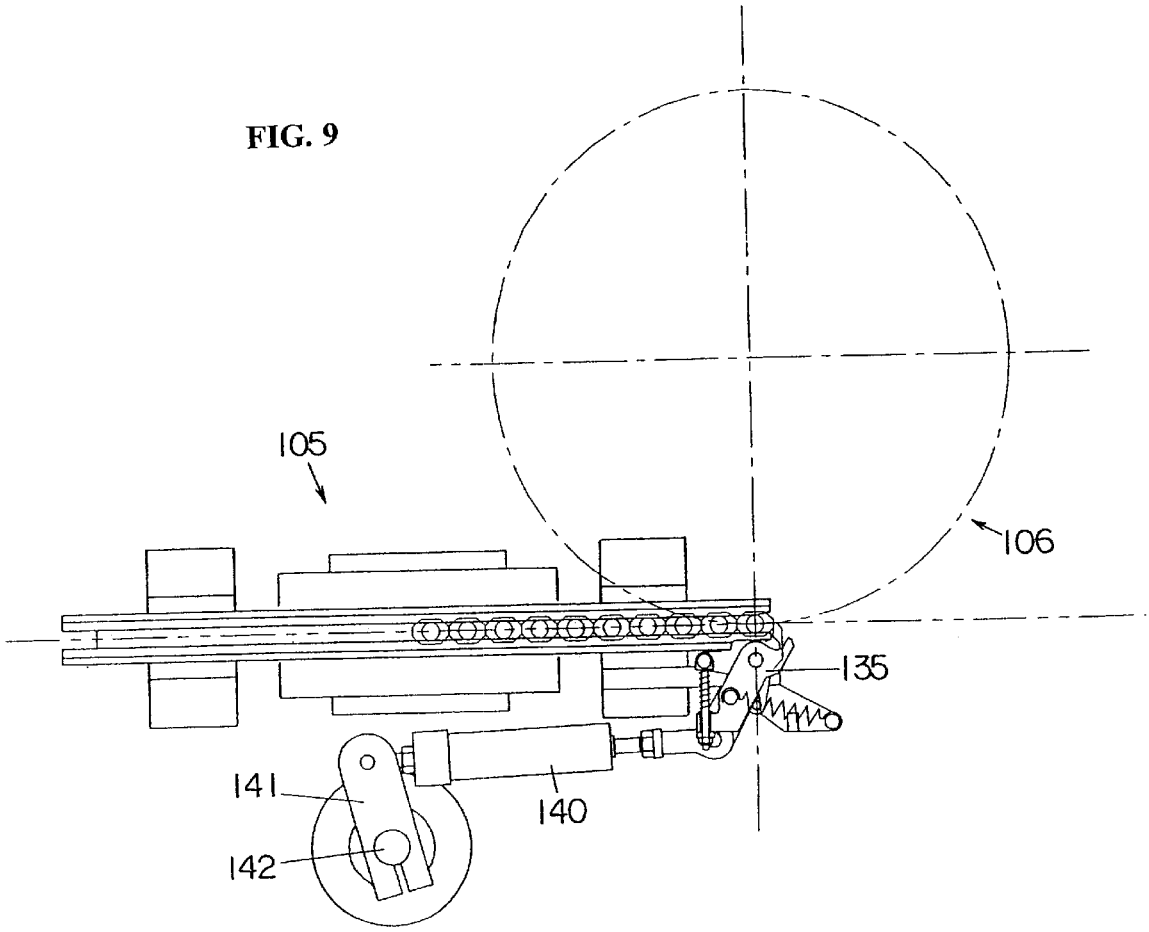
FIG. 9 is a top view of the positioning device in the spout positioning and supplying device.
Figure 10:
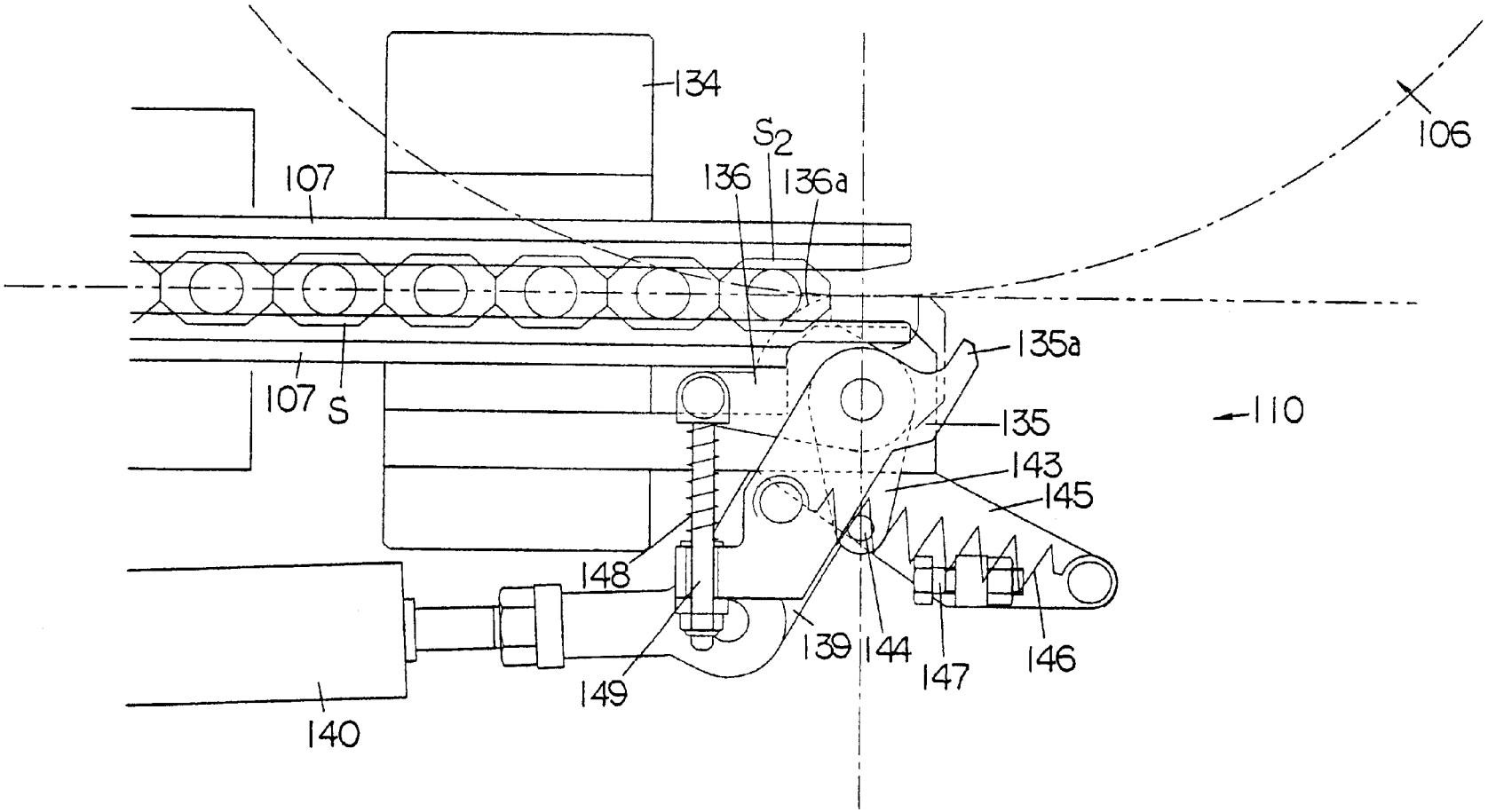
FIG. 10 is an enlarged view of essential parts of the same.
Figure 11:
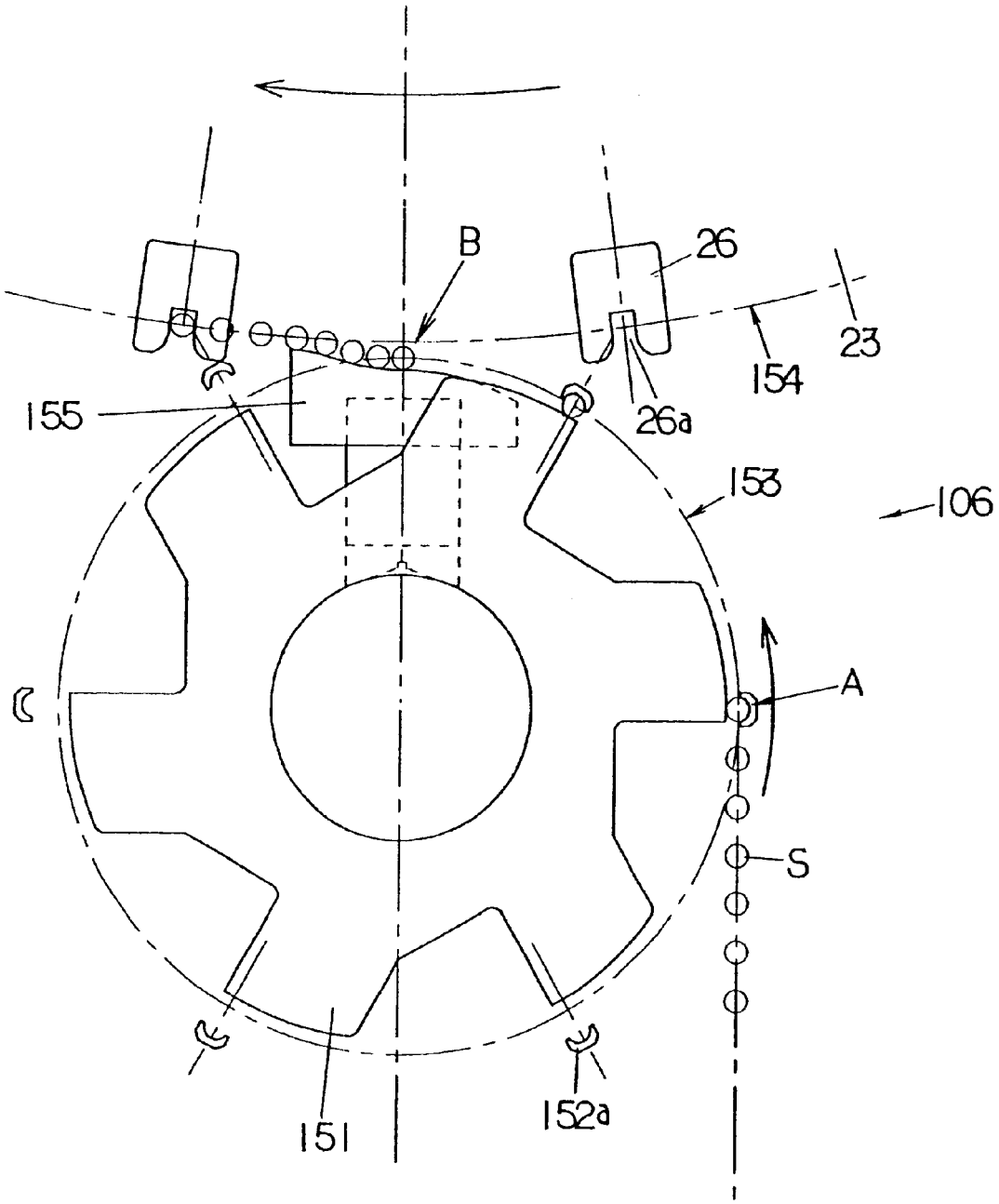
FIG. 11 is a schematic top view that illustrates the spout receiving operation performed by the spout transfer apparatus.

The spout insertion and temporary-sealing apparatus 2 is a rotary type apparatus; as shown in FIGS. 4 through 6, a table rotating shaft 22 is rotably supported inside a supporting stand 21 which is disposed in an upright position on the base 11, and a rotating table (rotor) 23 is fastened to this table rotating shaft 22. Furthermore, spout holding members 26 are attached at equal intervals (i.e., at the same spacing as the spacing of the transfer means 9 of the transfer device 8) via attachment supporting columns 24 that are disposed in upright positions on the outer circumference of the rotor 23, and attachment plates 25. The rotating table 23 rotates continuously, and is set so that the spout holding members 26 and transfer means 9 rotate at the same speed and with a matched timing. As best shown in FIG. 11, the spout holding members 26 are fork-shaped members which have clamping grooves 26*a* that face outward in the radial direction and clamp the groove parts between the flanges of the spouts S. Fan-shaped tapered surfaces that open outward are formed at the entry points of the clamping grooves 26*a*. The attachment plates 25 are annular members, and recessed portions 25*a* are formed in these parts of the attachment plates 25 that are near the spout holding members 26 so that the attachment plates 25 do not interfere with the clamping of the spouts. Furthermore, the attachment plates 25 also function as stopper members that are contacted by the upper ends of the bags so that the rising ends of the bags are regulated.

A pair of holding members 31, a bag bottom receiving stand 32 and a pair of suction plates 33 are disposed beneath each spout holding member 26; these parts correspond to the holding-and-insertion means referred to in the present invention.

The holding members 31 are members which are substantially V-shaped when viewed in a top view, and which each comprises an inner claw 31*a* and an outer claw 31*b*. The members have a specified length in the vertical direction, and are attached to the tip ends of respective pivoting holding arms 34 and 35. The holding members 31 open and close by swinging through a specified range. In an open state, the holding members 31 receive the bags W; the holding members 31 then close and hold both side edges of the bags W. The inner claws 31*a* have rectilinear holding surfaces that run more or less along the tangent of the rotational track of each inner claw 31*a*, while the outer claws 31*b* have holding surfaces that face slightly outward. The pairs of claws are installed facing each other, and the spacing between the inner claws 31*a* of the respective holding members 31 is set so that this spacing is narrower than the spacing of the outer claws 31*b*. Furthermore, the holding members 31 have cut-outs in two places, i.e., above and below, and bag introduction guides 36 and 37 which are disposed above and below the transfer means 9 of the transfer device 8 are positioned here.

Gears 38 and 39 are interposed between the holding arms 34 and 35 so that the holding arms 34 and 35 simultaneously pivot in an opening and closing action. Furthermore, the holding arm 34 is held so that it is pivotable on raising-and-lowering holder 41 via a bearing 42 (inner race 42*a* and outer race 42*b*), and an arm-swinging fulcrum shaft 43 is inserted into the inner race 42*a*. Longitudinal ribs are formed on the outer circumferential surface of the arm-swinging fulcrum shaft 43, and longitudinal grooves which slidably accommodate the longitudinal ribs are formed on the inner circumferential surface of the inner race 42*a*, thus allowing the bearing 42 (and raising-and-lowering holder 41) to rise and fall relative to the arm-swinging fulcrum shaft 43. Meanwhile, the holding arm 35 is arranged so that it is pivotable with respect to the raising-and-lowering holder 41 via an arm-swinging fulcrum shaft 44.

A raising-and-lowering slider 45 is fastened to the inside-diameter side of the raising-and-lowering holder 41 (center side of the rotating table 23), and this slider 45 slides along a raising-and-lowering rail 47 which is vertically installed on a bracket 46 attached to the undersurface of the rotating table 23. Furthermore, a cam roller 48 is disposed on the inside of this slider 45, and as the rotating table 23 rotates, this cam roller 48 runs through the cam groove of an annular raising-and-lowering cam 49 which is attached to the supporting stand 24. As a result, the raising-and-lowering holder 41 is raised and lowered (along with the holding members 31).

The arm-swinging fulcrum shaft 43 is supported so that it is pivotable by a bearing 51 in the vicinity of the lower end of the arm-swinging fulcrum shaft 43. The bearing 51 is attached to a supporting plate 52 which is fastened to the lower end of the bracket 46. A swinging arm 53 is fastened to the lower end of the swinging-arm fulcrum shaft 43, and this swinging arm 53 is connected via a connecting rod (not shown) to one end of a cam lever 55 which is shaft-supported on a bracket 54 on the undersurface of the supporting plate 52 so that the cam lever 55 is free to swing (in a relationship which is such that swinging arm 53 swings in the horizontal plane when the cam lever swings). A cam roller 56 is disposed on the other end portion of the cam lever 55, and this cam roller 56 runs through the cam groove 57 of an annular opening-and-closing cam 57 as the rotating table 23 rotates. As a result, the swinging arm 53 swings and the arm-swinging fulcrum shaft 43 pivots so that the holding arms 34 and 35 swing and the holding members 31 open and close.

The opening-and-closing cam 57 is fastened to the outer circumference of an annular attachment bracket 58. A plurality of female screw members 59 are disposed on the circumference of this attachment bracket 58, and rotating shafts 62 which are rotatably supported on a stand 61 disposed on the base 11 are engaged with the female screw members 59, so that the attachment bracket 58 is supported in a horizontal position. Gears 63 are attached to the lower ends of the rotating shafts 62, and the gears engage with the outer circumference of an intermediate gear 64 which is rotatably attached to the table rotating shaft 22. Furthermore, a sprocket 65 is fastened to one of the gears 63, and this is connected via a chain 66 and sprocket 67 to a rotating shaft 69 which is rotatably supported on a stand 68 disposed on the base 11. Accordingly, when a handle 71 which is fastened to the rotating shaft 69 is turned, the plurality of rotating shafts 62 rotate by the same amount, so that the bracket 58 and opening-and-closing cams 57 are raised and lowered while maintaining a horizontal attitude. Furthermore, the height of the opening-and-closing cams 57 is adjusted in accordance with the width of the bags.

A bag bottom receiving stand 32 is disposed beneath each pair of holding members 31. This bag bottom receiving stand has a receiving section which is substantially V-shaped as seen in a side view, and is elastically supported on a receiving stand holder 72 via a supporting shaft 73 and compression spring 74; the receiving stand holder 72 is fastened to a receiving stand attachment plate 75 by a high adjustment screw 76. A raising-and-lowering slider 77 is fastened to the receiving stand attachment plate 75; furthermore, a raising-and-lowering rail 79 is fastened in a vertical position to a bracket 78 which is attached to the raising-and-lowering holder 41, and the raising-and-lowering slider 77 slides along this raising-and-lowering rail 79. Furthermore, a cam roller 81 is attached to the lower end of the receiving stand attachment plate 75, and as the rotating table 23 rotates, this cam roller 81 runs over an annular receiving stand raising-and-lowering cam 83 which is attached to the base 11 via a bracket 82. As a result, the bag bottom receiving stand 32 is raised and lowered.

In the meantime, when bags of different lengths are processed, it is necessary to adjust the height of the bag bottom receiving stand 32. This adjustment can be done by means of the height adjustment screw 76. Variation in the length of bags that have the same nominal length is absorbed by elastic deformation of the compression spring 74.

A pair of suction plates 33 are positioned above the holding members 31. The respective suction plates 33 are attached facing the tip ends of opening arms 86 and 87 that are free to swing in the horizontal plane about respective swinging fulcrum shafts 84 and 85, and the suction plates 33 simultaneously pivot in an opening-and-closing action via gears 88 and 89. The swinging fulcrum shafts 84 and 85 are fastened to an attachment base 91 which is disposed on the upper end of the bracket 78, so that the suction plates 33 are raised and lowered together with the raising-and-lowering holder 41 (and holding members 31). The opening arms 86 and 87 are constantly driven in the opening direction by a compression spring 92, and the opening distance of the opening arms 86 and 87 is restricted by a stopper 93 which is attached to the attachment base 91. Meanwhile, a cam roller 94 is attached to the opening arm 86; this cam roller 94 contacts an opening arm swinging cam 95 which is disposed over a specified distance along the outer circumference of the rotating table 23, and thus closes the opening arms 86 and 87 and suction plates 33.

A rotary valve consisting of a rotating valve 96 which is fastened to the rotating table shaft 22 and a fixed valve 97 which is rotatably attached to the table rotating shaft 22 is disposed on the upper portion of the table rotating shaft 22. The fixed valve 97 is fixed in place by means of rotation-stopping rod 98, etc., and is elastically pressed against the rotating valve 96 by a pressing plate 99; furthermore, this fixed valve 97 is connected to a vacuum source in a connecting portion 101. Furthermore, the suction plates 33 are connected to respective vacuum ports 102 of the rotating valve 96, and the vacuum ports 102 are placed in communication with vacuum ports formed in the fixed valve 97, or removed from communication with the vacuum ports formed in the fixed valve 97, as the rotating table 23 rotates. Furthermore, a table rotating gear 103 which is connected to a driving source (not shown) is fastened to the lower portion of the table rotating shaft 22.

Next, the spout supply device 3 will be described with reference to FIGS. 7 through 15. As shown in FIG. 1, this spout supply device 3 comprises a parts feeder 104, a spout positioning and supplying device 105 and a spout transfer device 106. Spouts which are fed out in a single row from the universally known parts feeder 104 are fed forward and positioned in a specified position by the spout positioning and supplying device 105, and are then supplied to the spout holding members 26 of the spout insertion and temporary-sealing apparatus 2 via the spout transfer device 106.

Furthermore, it would also be possible to install two or more spout supply devices 3 around the circumference of the spout insertion and temporary-sealing apparatus 2.

As shown in FIGS. 7 through 10, the spout positioning and supplying device 105 comprises spout supplying rails 107 which support the flange portion c of the spouts from both sides and guide the spouts in a single row in the direction of length of the sealing portions f (i.e., the direction of width of the bags), a force-feeding device 108 which is disposed in the vicinity of the exit point of the spout supplying rails 107, an air-blowing nozzle 109 which is disposed in front of the force-feeding device 108, and a positioning device 110 which is disposed at the exit point.

The air-blowing nozzle 109 blows high-pressure air onto the spouts S that are fed by vibration, etc., over the spout supplying rails 107, and drives the spouts S toward the exit point, thus causing the spouts S to advance with the spouts S being maintained as tightly in contact with each other as possible. Here, this nozzle 109 acts to assist the force-feeding device 108.

The force-feeding device 108 is equipped with a pair of clamping plates 111 beneath the spout supplying rails 107; the clamping plates 111 repeat a cycle in which the clamping plates 111 clamp spouts S from both sides with the tip ends of the clamping plates 111, advance in this state, and then release the spouts S and withdraw. The clamping plates 111 are attached to respective swinging arms 113 and 114 via plate springs 112, and the respective swinging arms 113 and 114 are fastened to fulcrum shafts 116 and 117 that are shaft-supported on a supporting holder 115. It is arranged so that the swinging arms 113 and 114 can be caused to swing symmetrically by the engagement of gears 118 and 119 fastened to the respective fulcrum shafts 116 and 117. Furthermore, an intermediate lever 121 is fastened to the fulcrum shaft 117, and a rolling roller 122 is attached to the end portion of this intermediate lever 121.

The rolling roller 122 is free to roll inside a horizontal groove which is formed in the upper and of an opening-and-closing cam lever 123; this opening-and-closing cam lever 123 is raised and lowered by a raising-and-lowering cam 124 and a cam roller 125 which runs through the cam groove of this raising-and-lowering cam 124, and this raising-and-lowering action is guided by a raising-and-lowering rail 126 and a slider 127. Furthermore, the supporting holder 115 is connected via a bracket 129, etc., to a reciprocating cam lever 128 which is caused to perform a reciprocating motion by a cam not shown, so that the supporting holder 115 also performs a reciprocating motion, and this reciprocating motion is guided by a rail 131 and slider 132. Moreover, 133 and 134 indicate attachment stands for the spout supplying rails 107.

The raising-and-lowering cam lever 123 rises and falls so that the swinging arms 113 and 114 swing, thus causing the clamping plats 111 to open or close so that the spouts S are clamped or released. Furthermore, the supporting holder 115 performs a reciprocating motion so that the clamping plates 111 perform a reciprocating motion; as a result, the clamping plates 111 repeat an operation in which the clamping plates 111 advance while clamping the spouts, and then release the spouts and withdraw. Consequently, the spouts are driven toward the exit point over the spout supplying rails 107, and advance in a state of close contact with each other. Leakage in the supply of spouts during high-speed operation can be prevented by forcibly feeding the spouts in the vicinity of the exit point of the spout supplying rails 107 so that the spouts are placed in a state of close contact with each other.

Furthermore, since plate springs 112 are interposed between the clamping plates 111 and swinging arms 113 and 114, the clamping plates 111 slip over the clamped spouts S when the spouts S are stopped at the exit point of the spout supplying rails 107 and packed in a state of close contact with each other. In this way, no excessive force is applied to the spouts S or the exit point of the spout supplying rails 107.

The positioning device 110 is equipped with an opening-and-closing stopper 135 and a separating stopper 136 which are disposed at the exit point of the spout supplying rails 107. The opening-and-closing stopper 135 is attached to a supporting shaft 137 on the upper side of the spout supplying rails 107, and is caused to swing by a mechanism that will be described later. When the claw 135*a* on the tip end of the opening-and-closing stopper 135 closes off the exit of the spout supplying rails 107, the front ends of the flange portion a through c of the leading spout $S_1$ that has advanced toward the exit contact this claw 135*a*, so that the spout $S_1$ is stopped and positioned at this point. Furthermore, the separating stopper 136 is likewise rotatably attached to a supporting shaft 137 on the lower side of the spout supplying rails 107. When the opening-and-closing stopper 135 is open, this separating stopper 136 closes, and the circular-arc-shaped surface of the pivoting claw part 136*a* of the separating stopper 136 contacts the sealing portion f of the second spout $S_2$ or a point slightly below this sealing portion f, and anchors this part so that the advance of the spout $S_2$ is stopped. When the opening-and-closing stopper 135 closes, the separating stopper 136 opens to that the anchoring is released, thus allowing the advance of the spout $S_2$ (which is the leading spout at this point in time).

The supporting shaft 137 is rotatably shaft-supported on a supporting holder (not shown) which is attached to the attachment stand 134; this supporting shaft 137 is connected to a swinging lever 141 via an intermediate lever 139 and air cylinder 140. Furthermore, the swinging lever 141 is attached to a fulcrum shaft 142 which is caused to perform a reciprocating pivoting motion with a fixed timing by a cam (not shown), so that the swinging lever 141 swings. A stopper-opening arm 143 is fastened to the supporting shaft 137, and a stopper-opening rod 144 is installed in an upright position on this stopper-opening arm 143. Furthermore, a tension spring 146 is installed between a bracket 145 that extends from the attachment stand 134 and the opening-and-closing stopper 135, so that the opening-and-closing stopper 135 is constantly driven and pressed toward the stopper-opening bar 144 (i.e., in the closing direction of the opening-and-closing stopper 135). Furthermore, an adjustable positioning stopper 147 that regulates the swinging end of the opening-and-closing stopper 135 is attached to the bracket 145.

The opening-and-closing stopper 135 and separating stopper 136 are respectively connected at one end by a guide shaft 149 which has a compression spring 148 attached to its outer circumference; furthermore, this guide shaft 149 passes through a hole formed in the opening-and-closing stopper 135. As a result, the separating stopper 136 and opening-and-closing stopper 135 ordinarily maintain a specified positional relationship with each other; furthermore, if a force is applied against the driving force of the compression spring 148, this force is absorbed by a reduction in the angle between the two parts.

As a result of the above-described mechanism, when the fulcrum shaft 142 swings, the supporting shaft 137 is caused to pivot via the swinging lever 141, air cylinder 140 and intermediate lever 139; accordingly, the stopper-opening arm 143 swings, and the opening-and-closing stopper 135 and separating stopper 136 pressed against this stopper-opening arm 143 swing, so that the above-described operation is performed with a fixed timing.

Furthermore, in the positioning device 110, the swinging lever 141 always swings with a fixed timing, so that the opening-and-closing stopper 135 is ordinarily opened and closed with a fixed timing. However, in cases where some abnormality occurs, the air cylinder 140 can be actuated, so that the swinging of the swinging lever 141 is cancelled by the extension or retraction of the rod of the air cylinder 140, thus causing the opening-and-closing stopper 135 to be kept in a closed state by the driving force of the tension spring 146.

Figure 12:
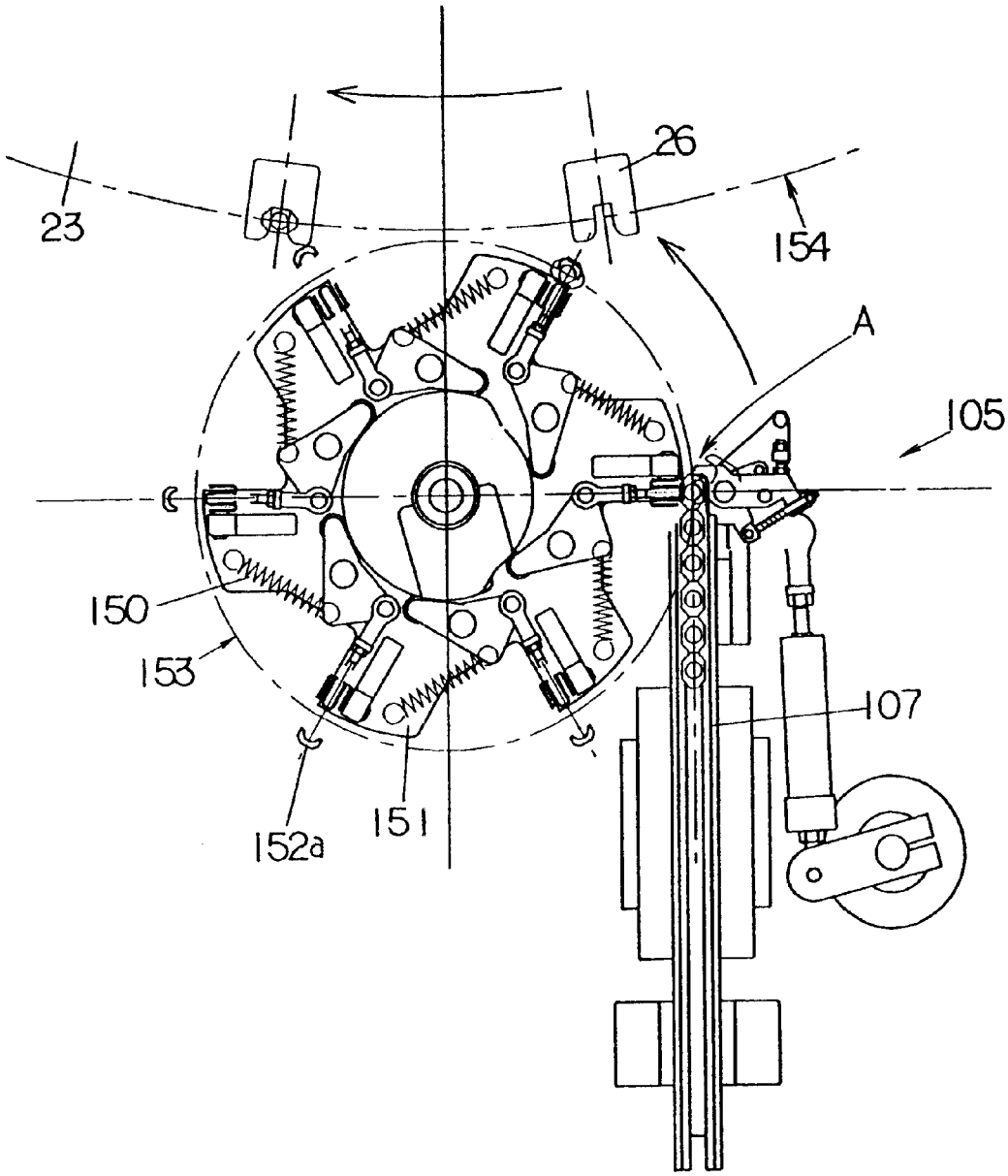
FIG. 12 is a schematic top view that illustrates the spout transfer operation performed by the spout transfer apparatus.
Figure 13:
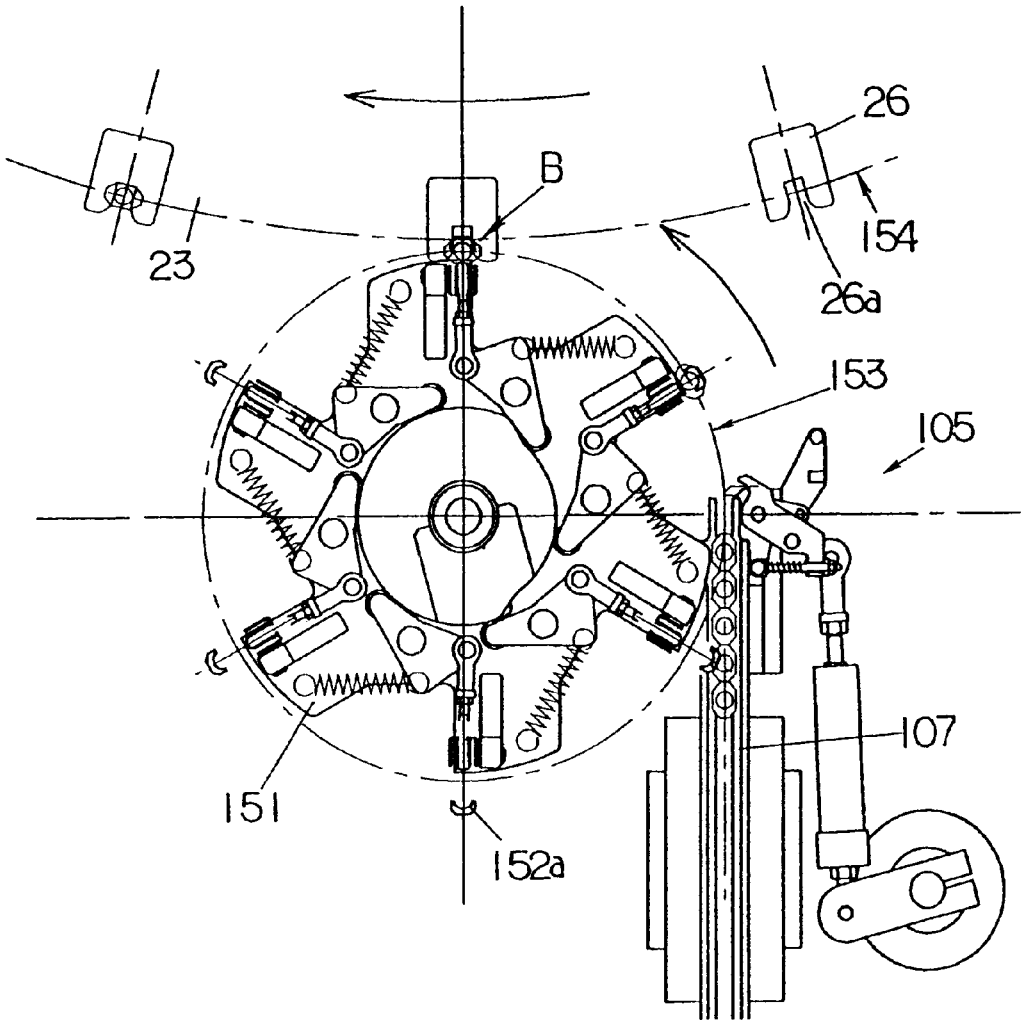
FIG. 13 is a schematic top view which illustrates the spout push-in operation performed by the spout transfer apparatus.
Figure 14:
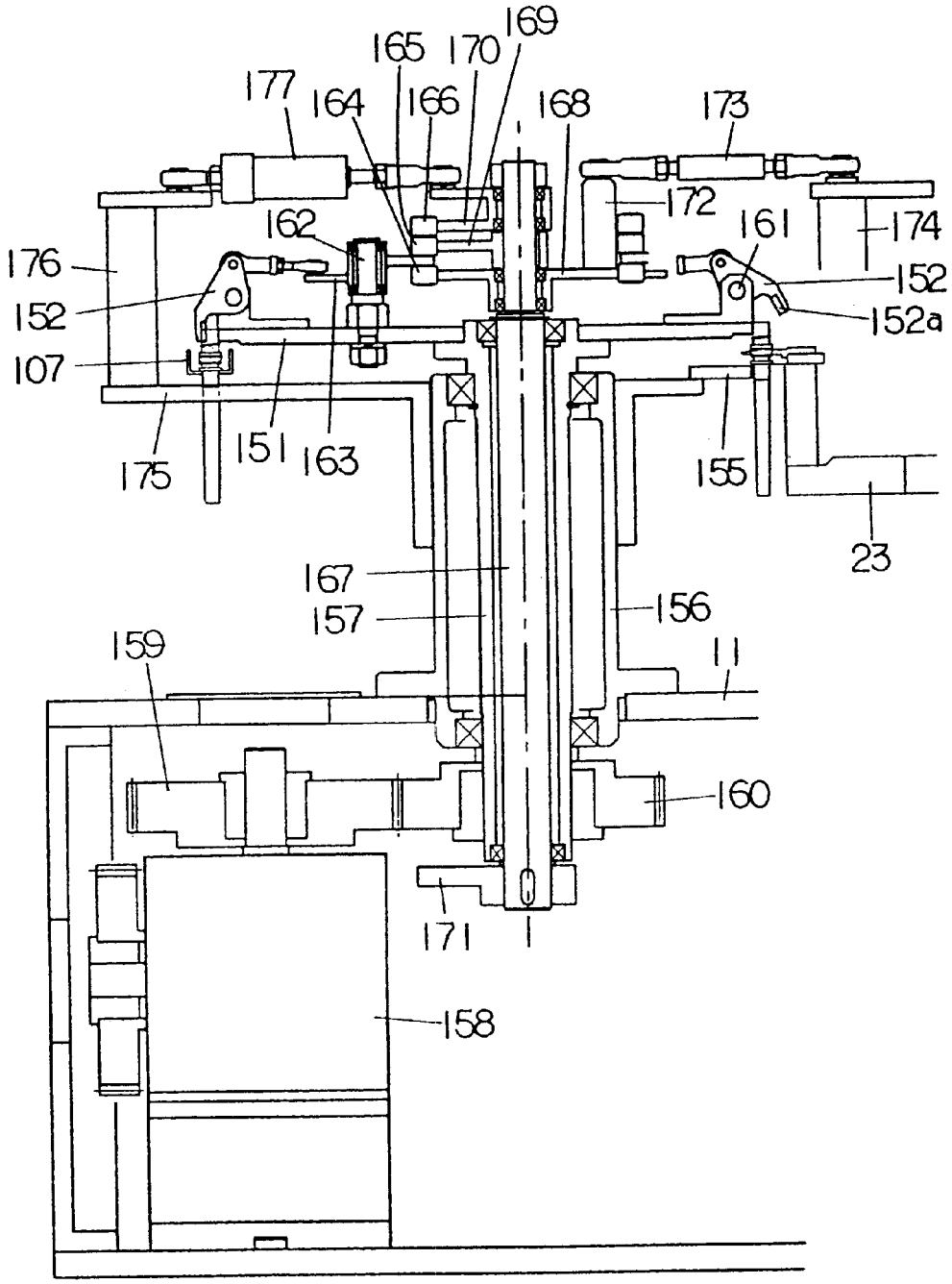
FIG. 14 is a sectional view of the spout transfer apparatus.

As shown in the simplified FIG. 11 and in FIGS. 12 and 13, the spout transfer device 106 is equipped with a transfer rotor 151 that rotates intermittently. Spout gripping members (spout transfer means) 152 which have gripping sections 152*a* that open and close are disposed on the circumference of the transfer rotor 151 (only the gripping sections 152*a* are shown in FIGS. 1 through 13), and the head portion h of the spouts S that are successively positioned at the exit point of the spout supplying rails 107 are gripped and received by the spout gripping members 152 (the opening-and-closing stopper 135 opens with a timing that is matched to this gripping action). The spouts are then conveyed and transferred to the spout holding members 26 on the rotating table 23 of the spout insertion and temporary-sealing apparatus 2, the rotating table 23 rotating continuously.

The transfer rotor 151 intermittently rotates a specified angle (60°) at a time in a cycle that comprises stopping, acceleration, constant speed, deceleration and stopping. When the transfer rotor 151 stops, the spout gripping members 152 stop in the receiving position for the positioned spout (see FIG. 12). Meanwhile, the conveying track of the centers of the spout holding positions of the spout gripping members 152 is set so that it approaches and gets close to the conveying track 154 of the centers of the spout holding positions of the spout holding members 26. It is arranged so that the transfer rotor 151 rotates at a constant speed in the vicinity of the transfer position B where the spouts are transferred to the spout holding members 26 (i.e., the position where both conveying tracks are in closest proximity to each other), and so that the spout gripping members 152 rotate at the same speed as the spout holding members 26, with both parts running side by side. During this period of constant-speed rotation, the spouts S gripped by the spout gripping members 152 are introduced into the clamping grooves 26*a* (tapered portions) of the spout holding members 26 (see FIG. 13). Furthermore, after the spouts S have been introduced into the clamping grooves 26*a* of the spout holding members 26, the spout gripping members 152 open and release the spouts S at the spout transfer position B.

A push-in guide member 155 which has a guide surface that contacts the conveyed spouts S and guides the spouts S from the conveying track 153 toward the conveying track 154 is disposed in a position beneath the transfer rotor 151 (below the flanges c of the spouts S) in the vicinity of the transfer position B. The spouts S that have been introduced into the clamping grooves 26*a* of the spout holding members 26 contact this push-in guide member 155 at a point preceding the transfer position B, and are guided by this push-in guide member 155 as the spout holding members rotate, so that the spouts S are pushed in as far as the centers of the spout holding positions of the clamping grooves 26*a* (see FIG. 11; the movement of the spouts S is shown in a time sequence).

In this transfer device 106, the spouts S that are stopped and positioned in a specified position are received by spout gripping members 152 that are similarly stopped. Accordingly, transfer errors tend not to occur. Furthermore, since the spouts S are transferred from spout gripping members 152 that rotate at the same speed as the continuously rotating spout holding members 26, high-speed processing is possible.

The transfer device 106 will be described below in detail with reference to FIGS. 14 through 17.

First, the transfer rotor 151 is attached to a hollow rotating shaft 157 that is rotatably supported inside a stand 156 that is installed in an upright position on the base 11. This transfer rotor 151 is caused to perform the intermittent rotation by means of an indexing device 158 connected to a driving source (not shown), gears 159 and 160, and the hollow rotating shaft 157. Furthermore, the indexing device is a device which converts the input of a continuous rotation into an intermittent rotation and outputs this intermittent rotation; this device is in itself universally known.

A plurality of spout gripping members 152 are disposed at equal intervals on the transfer rotor 151. The spout gripping members 152 are free to swing about fulcrum shafts 161; as a result, the gripping sections 152*a* open and close in a vertical plane that is parallel to the radial direction of the transfer rotor 151. When the gripping sections 152*a* close, the gripping sections 152*a* grip the heads h of the spouts S between the gripping sections 152*a* themselves and the circumferential surface of the transfer rotor 151. Cam levers 163 which swing horizontally about swinging shafts 162 are installed in positions that correspond to the respective spout gripping members 152. One end of each of the cam levers 163 is connected to the rear end of the corresponding spout gripping member 152 via a connecting rod, and three cam rollers 164 through 166 which are rotatable relative to each other are coaxially attached to the other end (inside-circumferential end) of each cam lever 163. One end of each cam lever 163 is driven toward the outer circumference, and the other end is driven toward the inner circumference, by a tension spring 150. As a result, the cam rollers 164 through 166 are pressed against a cam (described later) on the inside.

A pivoting shaft 167 is installed inside the hollow rotating shaft 157 so that the pivoting shaft 167 is rotatable relative to the hollow rotating shaft 157. Three cams 168 through 170 which have cam surfaces along which the cam rollers 164 through 166 run are attached to the upper part of the pivoting shaft 167. A pivoting lever 171 is fastened to the lower end of the pivoting shaft 167, and this pivoting lever 171 is caused to swing horizontally by a cam (not shown), so that the pivoting shaft 167 is caused to perform a reciprocating pivoting motion through a specified angular range with a specified timing.

Figure 15:
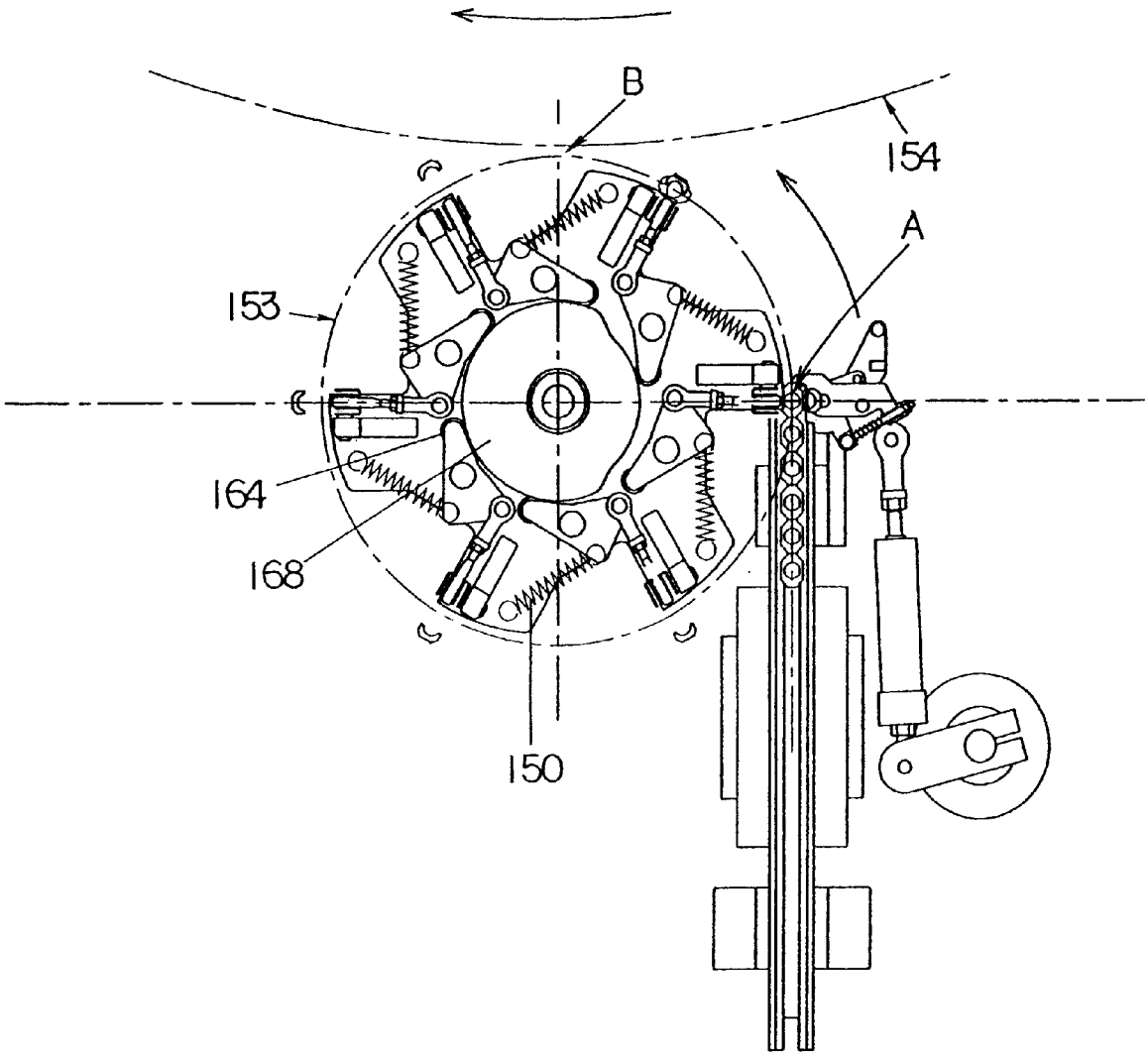
FIG. 15 is a top view of a portion of the opening-and-closing cam mechanism of the spout gripping members.

The cam 168 is arranged so that the cam 168 is rotatable relative to the pivoting shaft 167; furthermore, this cam 168 is fastened via a rotating-stopping block 172, fastening rod 173 and supporting column 174 to a fastening plate 175 installed on a stand 156. As shown in FIG. 15, the shape of this cam 168 as seen in a top view comprises a large-diameter part which opens the gripping sections 152*a* of the spout gripping members 152, and a small-diameter part which closes the gripping sections 152*a*. In terms of the position of the spout gripping member 152, the small-diameter part of the cam 168 is formed so that it extends from a point preceding the receiving position A to the vicinity of the transfer position B.

Figure 16:
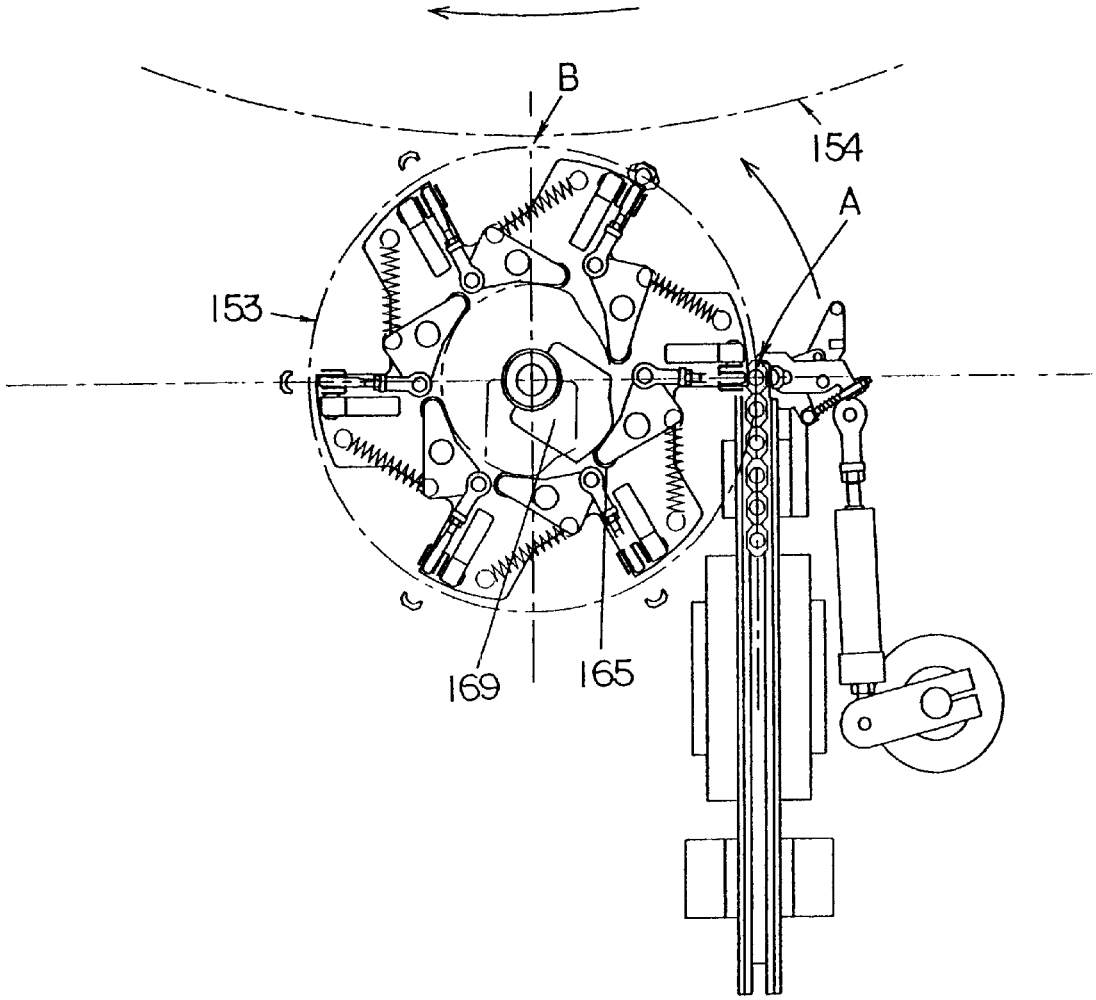
FIG. 16 is a top view of another portion thereof.

The cam 169 is fastened to the pivoting shaft 167. As shown in FIG. 16, the cam 169 comprises a large-diameter portion and a small-diameter portion which respectively has the same diameter as the corresponding portions of the cam 168. A cam roller 165 is caused to contact the large-diameter portion, so that this cam 169 pivots following the transfer rotor 151 from the position indicated by an imaginary line (i.e., the position where the large-diameter portion overlaps with the large-diameter portion of the cam 168) to the position indicated by the solid line (i.e., the position where the spout gripping member 152 reaches the receiving position A); then, when the cam 169 reaches the position indicated by a solid line, the cam 169 pivots in the reverse direction and returns to the position indicated by an imaginary line. This operation is repeated each time that a spout gripping member 152 rotates into the above-described position (i.e., six times in each revolution of the transfer rotor 151).

The cams 168 and 169 are used in ordinary operation. When the spout gripping members 152 perform an intermittent rotation accompanying a single intermittent rotational movement of the transfer rotor 151, the cam roller 164 rides on the large-diameter part of the cam 168 so that the gripping sections 152*a* open. Then, the cam roller 165 rides on the large-diameter part of the cam 169, and these parts rotate together until the receiving position A is reached, whereupon the cam 169 pivots in the reverse direction, and the cam roller 165 abruptly drops onto the small-diameter part of the cam 169 (at the same time, the cam roller 164 also drops onto the small-diameter part of the cam 168), so that the gripping sections 152*a* quickly close.

Figure 17:
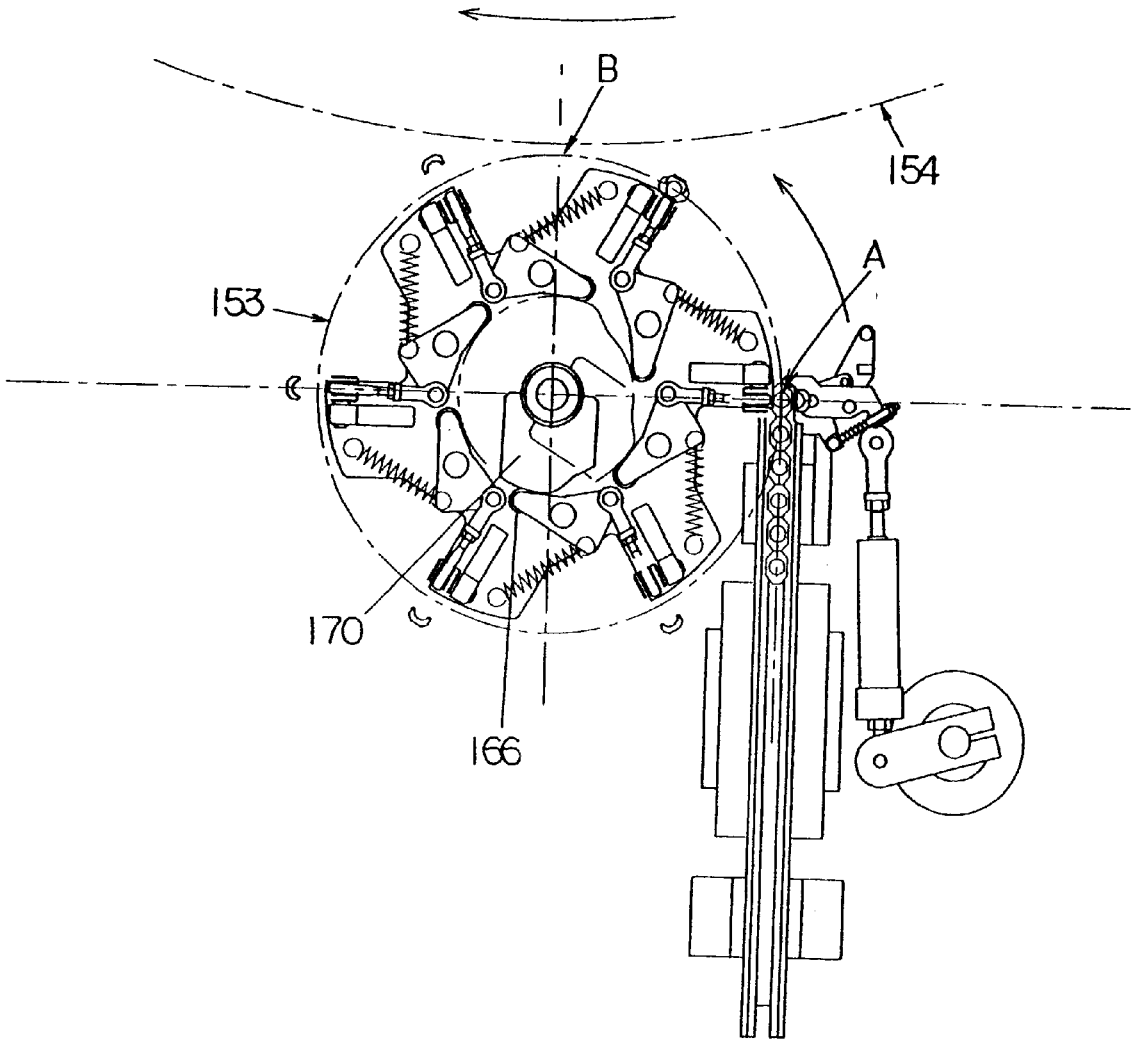
FIG. 17 is a top view of still another portion thereof.

Meanwhile, the cam 170 operates in cases where some type of trouble occurs. This cam 170 is rotatably attached to the pivoting shaft 167, and the cam 170 can be caused to pivot by an air cylinder 177 which is attached to a supporting column 176 installed in an upright position on the fastening plate 175. As shown in FIG. 17, the cam 170 has a plan-view shape similar to that of the cam 169 and is ordinarily positioned in the position indicated by a solid line (i.e., the position where the large-diameter part of this cam 170 overlaps with the large-diameter part of the cam 168). When the air cylinder 177 is actuated, the cam 170 pivots to the position indicated by an imaginary line (i.e., the position at which the spout gripping member 152 reaches the receiving position A). Thus, the cam roller 166 rides on the large-diameter part of the cam 170, thus preventing the gripping sections 152*a* from closing. When the corresponding spout gripping member 152 rotates from the receiving position A, the cam 170 returns to its ordinary position.

Figure 18:
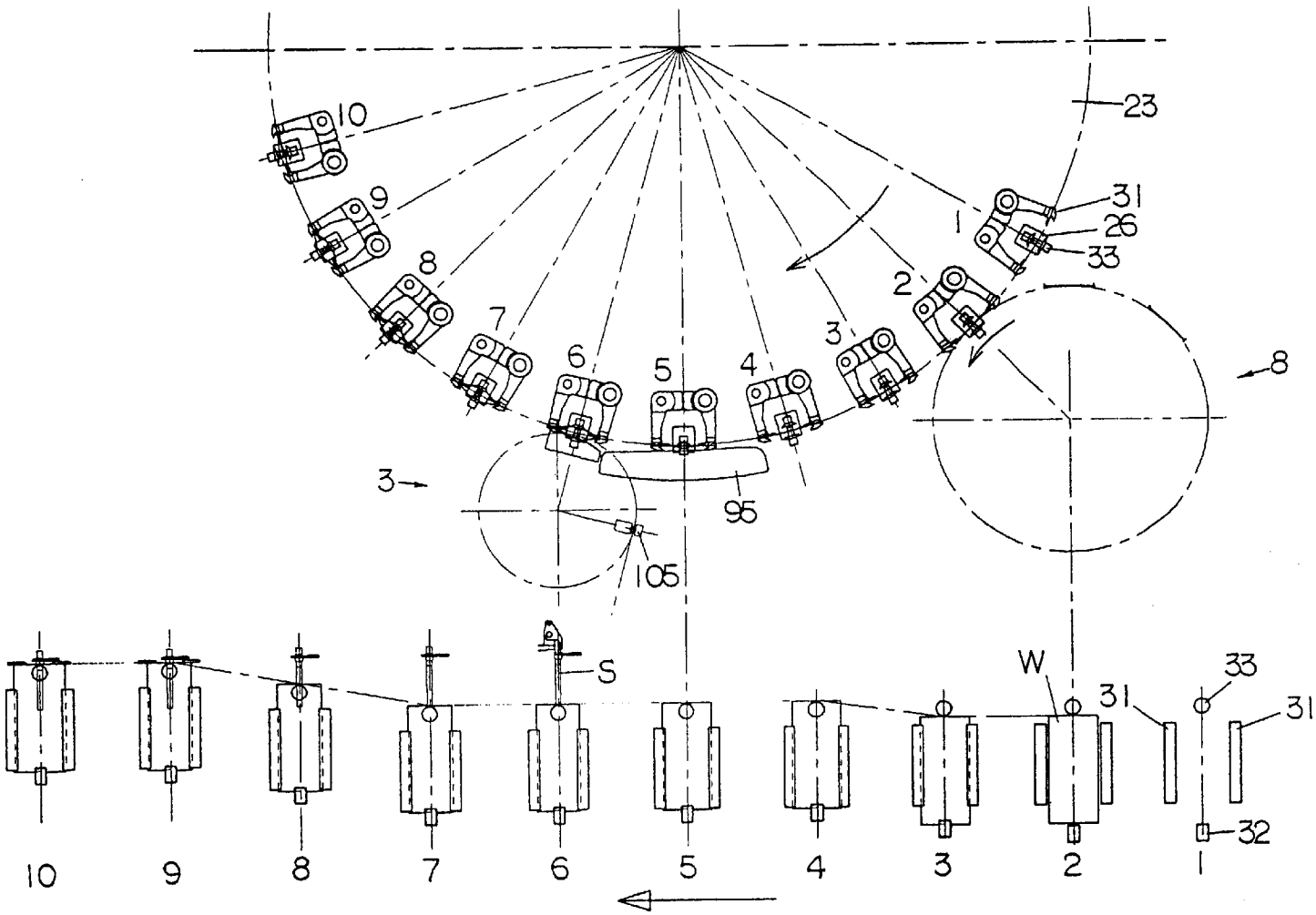
FIG. 18 is a diagram illustrating the operation of the holding-and-insertion means of the spout insertion and temporary-sealing apparatus.

Next, the operation of the bag holding-and-insertion means (holding members 31, bag bottom receiving stand 32 and pair of suction plates 33) in the spout insertion and temporary-sealing apparatus 2 will be described with reference to FIG. 18. The following numbers in parentheses more or less correspond to the numbers 1 through 10 shown in FIG. 18.

Figure 19C:
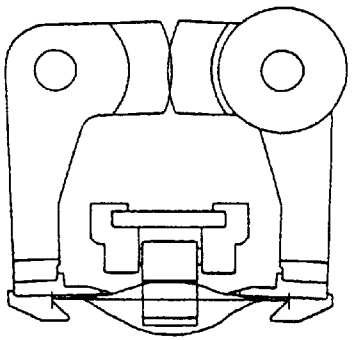
FIGS. 19A, 19B and 19C illustrate the operation of the holding members.

(1~2) When the continuously rotating transfer means 9 of the transfer device 8 chuck the bags W held by the bag conveying device 6 and rotate by approximately ⅝ of a revolution so that the transfer means 9 approach the bag holding members 26 of the likewise continuously rotating rotating table 23, the bags W make rubbing contact with the bag introduction guides 36 and 37, so that the bags are guided toward the holding members 31. At the same time, the transfer means 9 are connected to the atmosphere-release port 17 so that suction is stopped; as a result, the bags W chucked by the transfer means 9 to this point are respectively introduced into the gaps between the inner claws 31*a* and outer claws 31*b* of the facing holding members 31. Needless to say, the opening of the pairs of holding members 31 is set so that the gap between the two outer claws 31*b* is greater than the bag width (see FIG. 19A). However, the gap between the two inner claws 31*a* is always less than the bag width.

Figure 19B:
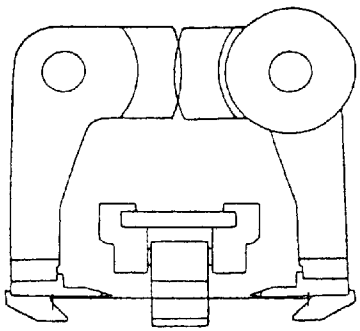
Figure 19A:
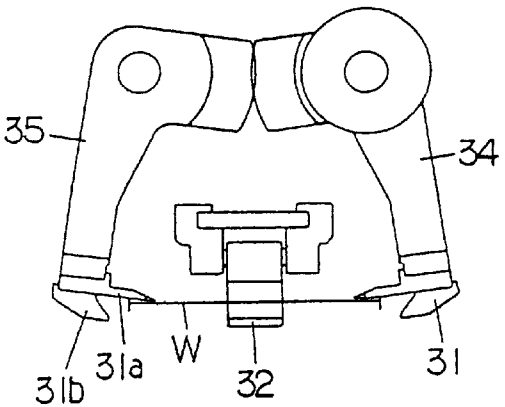

(3) The pair of holding members 31 are closed (in the direction of width), so that the gap between the V-shaped valley parts becomes approximately the same as the bag width, and both side edges of the bags W are thus held (see FIG. 19B). Furthermore, the bag bottom receiving stand 32 begins to rise and receives the lower end of the bag W.

(4) The bag bottom receiving stand 32 is raised further, and positions the mouth of the bag W at an intermediate point between the suction plates 33. The suction plates 33 initiate a suction action at this point.

(5) The cam roller 94 contacts the opening arm swinging cam 95, and the suction plates 33 close and chuck both surfaces of the bag W.

(6) The cam roller 94 separates from the opening arm swinging cam 95, and the suction plates 33 open, so that the bag mouth is opened. At the same time, the holding members 31 are closed further inward (in the direction of width), so that both side edges of the bag are held in accordance with the reduction in the width of the bag that occurs when the mouth of the bag is opened (see FIG. 19(*c*)). Meanwhile, a spout S is supplied to the spout holding member 26 from the spout gripping members 152 of the spout supply device 106.

(7~9) The raising-and-lowering holder 41 and the receiving stand holder 72 begin to rise at the same time, and the holding members 31, suction plates 33 and bag bottom receiving stand 32 begin to rise at the same time. As a result, both side edges of bags W whose mouths have begun to be opened are held by the holding members 31, and the bags W are raised vertically in a state in which the center of the bag in the direction of width is positioned at the center of the spout S, so that the bag is fitted over the spout S. During this period, the suction plates 33 cease to apply suction at the point where the upper end of the bag W crosses the lower end of the sealing portions f of the spout S, so that the bag W is released.

The raising-and-lowering holder 41 and the receiving stand holder 72 are raised and stopped in a set position. This position is set so that the upper end of the bag W contacts the attachment plate 28 (which functions as a contact member that restricts the rising end of the bag) and stops immediately prior to the stopping of the raising-and-lowering holder 41 and the receiving stand holder 72. When the bag W stops, the bag bottom receiving stand 32 simultaneously ceases any further rise; on the other hand, the raising-and-lowering holder 41 and receiving stand holder 72 continue to be raised slightly to a set position, and the rise of the receiving stand holder 72 is absorbed by the compression spring 74. The reason for using such an arrangement is to allow accurate positioning of the upper end of the bag W at the upper end of the sealing portions f of the spout S even if there is some variation in the length of the bags W. Such variation in the length of the bags W is absorbed by the elastic deformation of the compression spring 74.

(10) The bags W and spouts S are rotationally conveyed to the temporary-sealing apparatus 4 in a positioned state.

Figure 20A:
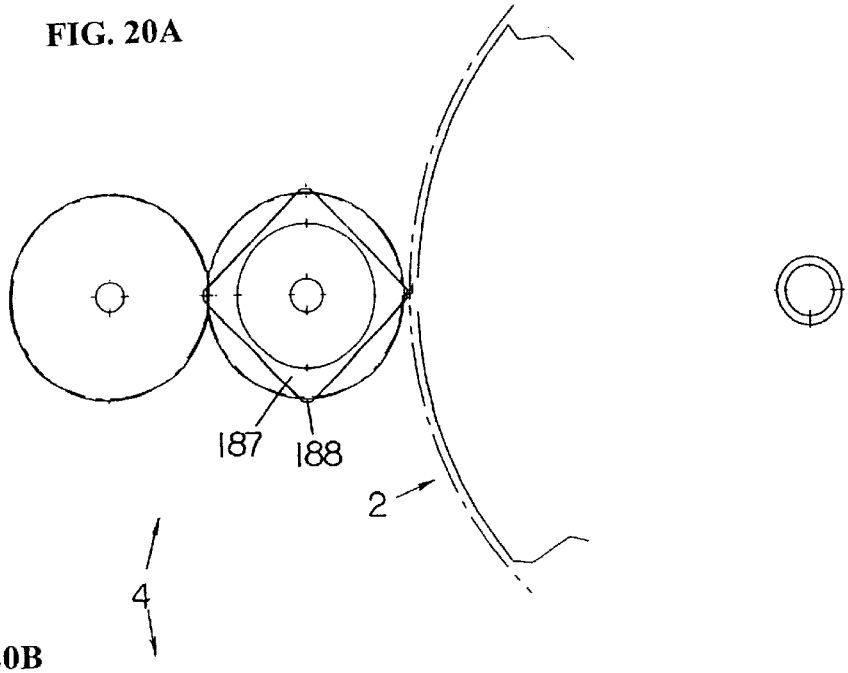
FIGS. 20A and 20B are side views of the temporary-sealing apparatus.
Figure 20B:
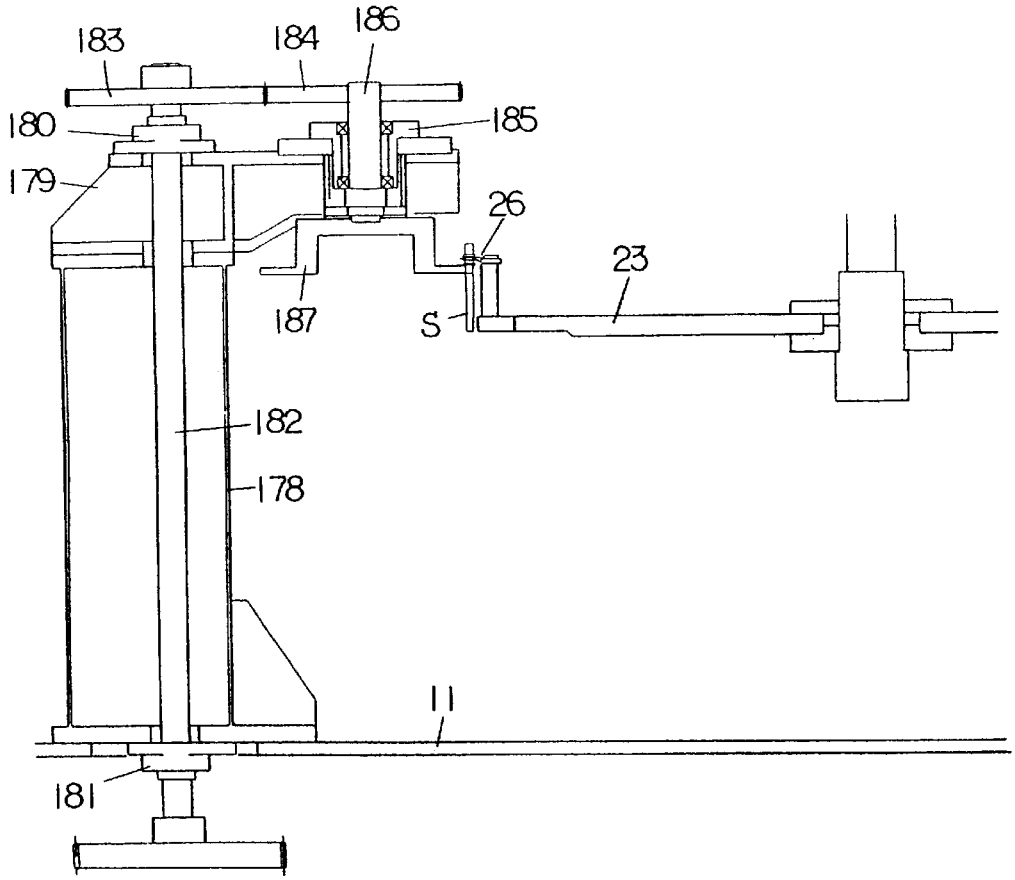

Next, the temporary-sealing apparatus 4 will be described with reference to FIG. 20.

The temporary-sealing apparatus 4 is equipped with a supporting stand 178 which is installed in an upright position on the base 11, a frame 179 which is attached to the upper part of the supporting stand 178, a rotating shaft 182 which is supported on bearings 180 and 181, a holding shaft 186 which is caused to rotate via gears 183 and 184 and is supported on a bearing 185, and a rotating sealing body 187 which is attached to the lower end of the holding shaft 186, etc. This temporary-sealing apparatus 4 is heated by a heater which is not shown. As the rotating sealing body 187 rotates, a temporary-sealing portion 188 rotates with a timing that is matched to the rotation of the spout holding members 26 of the rotating table 23. The temporary-sealing portion 188 is thus pressed toward the sealing portions of the spouts S held by the spout holding members 26. In this position, bags W are fitted over the spouts S, and the sealing portions of the bags W and sealing portions of the spouts S are temporarily sealed.

The transfer device 106 is positioned so that after bags have been supplied to the holding members 31 in the spout insertion and temporary-sealing apparatus 2, and the bags have been opened by the suction plates 33, spouts S corresponding to the bags are received in the transfer device 106. Furthermore, though not shown, a detection device which detects faulty supply of the bags (e.g., in cases where bags inside the holding members 31 cannot be detected by a CCD camera, this is judged to be faulty supply by the control device), and a detection device which detects faulty opening of the bags (the degree of vacuum in the piping of the suction plates 33 is detected, and if this degree of vacuum does not rise to a specified degree of vacuum during chucking, this is judged to be faulty opening (due to faulty chucking) by the control device) are installed, and in cases where there is faulty supply and/or faulty opening, the control device actuates the air cylinder 140 of the spout positioning and supplying device 105 for the spout S (that have been supplied) for the bag in question. In other words, in cases where the corresponding spout S has arrived at the head of the spout supplying rails 107, the opening-and-closing stopper 135 remains closed, and the gripping sections 152*a* do not close at the receiving position A. Accordingly, the supply of an unnecessary spout is prevented.

As seen from the above, in the present invention, in a rotary type transfer device that transfers spouts positioned in a specified position to a continuously rotating working rotor, the spouts that are stopped and positioned in a specified position are received by similarly stopped spout transfer means. Accordingly, transfer errors can be avoided. Furthermore, since the spouts are transferred to continuously rotating spout holding members from spout transfer means that are rotating at the same speed, high-speed operation can be assured.

What is claimed is:

1. A spout transfer method which uses a transfer rotor that has a plurality of spout transfer means disposed on its circumference, wherein said transfer rotor receives spouts using said spout transfer means and conveys said spouts and transfers said spouts to a plurality of spout holding members disposed on a circumference of a continuously rotating rotor, and wherein:

said transfer rotor is rotated intermittently by a specified angle at a time in a cycle that comprises stopping, acceleration, constant speed, deceleration and stopping, said spout transfer means receives, when said transfer rotor is stopped, said spouts positioned in a specified position, during a period of said constant-speed rotation said spout transfer means are rotated at a speed that matches a speed of said spout holding members, and both of said spout transfer means and said spout holding members are caused to run side by side, and during this period said spouts are transferred from said spout transfer means to the spout holding members.

2. A spout transfer apparatus which receives spouts positioned in a specified position, conveys said spouts and transfers said spouts to a plurality of spout holding members which are disposed on a circumference of a continuously rotating working rotor, said spout transfer apparatus comprising:

a transfer rotor which has a plurality of spout transfer means disposed on a circumference thereof, and a driving means which causes said transfer rotor to rotate intermittently by a specified angle at a time in a cycle that comprises stopping, acceleration, constant speed, deceleration and stopping, so that said driving means causes the spout transfer means, during said period of constant-speed rotation, to match a speed of said spout holding members and causes said spout transfer means and said spout holding members to run side by side during said period of constant-speed rotation; and wherein:

the spout transfer means receive positioned spouts when the transfer rotor is stopped, and the spout transfer means transfers said spouts to said spout holding members during said period of constant-speed rotation.

3. The spout transfer apparatus according to claim 2, wherein:

a conveying track of centers of spout holding positions of the spout transfer means and a conveying track of centers of the spout holding positions of the spout holding members are set to be close to each other, and the transfer rotor is rotated at a constant speed in a vicinity of a position of closest proximity of said two conveying tracks.

4. The spout transfer apparatus according to claim 2, wherein:

said spout holding members are fork-shaped members which have clamping grooves that are oriented outward in a radial direction so as to hold groove portions located between flanges of said spouts, and tapered surfaces that open outward are formed in a vicinity of an entry point of said clamping groove.

5. The spout transfer apparatus according to claim 4, wherein:

a conveying track of centers of spout holding positions of the spout transfer means and a conveying track of centers of the spout holding positions of the spout holding members are set to be close to each other, and the transfer rotor is rotated at a constant speed in a vicinity of a position of closest proximity of said two conveying tracks, so that the spouts held by the spout transfer means are introduced into clamping grooves of the spout holding members while the transfer rotor is rotating at said constant speed, and a push-in guide member is provided which has a guide surface that contacts spouts introduced into the clamping grooves and guides said spouts from said conveying track of centers of to spout holding positions of the spout transfer means toward the conveying track of centers of the spout holding positions of the spout holding members.

6. The spout transfer apparatus according to any one of claims 2 through 5, wherein said spout transfer means have gripping sections that open and close, and head portions of said spouts are gripped by said gripping sections.

7. The spout transfer apparatus according to claim 2, wherein said spout transfer apparatus is provided adjacent to a spout insertion and temporary-sealing apparatus, said spout insertion and temporary-sealing apparatus:

comprises a plurality of spout holding members disposed on a circumference of a continuously rotating rotor and bag holding-and-insertion means that correspond to said respective spout holding members, and opens said bags held by said bag holding-and-insertion means, fits said bags over spouts held by said spout holding members, and then temporarily seals said bags and spouts.

8. The spout transfer apparatus according to claim 7, wherein in a case that a timing is set in the transfer apparatus so that spouts that correspond to bags supplied to the holding-and-insertion means of the spout insertion and temporary-sealing apparatus are received after said bags have been supplied, a detection device which detects faulty supply of bags to said holding-and-insertion means is provided, and a regulating means which stops receiving of corresponding spouts by the spout transfer means based upon a detection signal of said detection device is provided.

9. The spout transfer apparatus according to claim 7, wherein in a case that a timing is set in the transfer apparatus so that spouts that correspond to bags opened by the holding-and-insertion means of the spout insertion and temporary-sealing apparatus are received after said bags have been opened, a detection device which detects faulty opening of bags by said holding-and-insertion means is provided, and a regulating means which stops receiving of corresponding spouts by the spout transfer means based upon a detection signal of said detection device is provided.

10. A spout positioning and supplying apparatus which supplies spouts to a spout transfer apparatus defined in claim 2, wherein said spout positioning and supplying apparatus is comprised of:

spout supply rails which support bottoms of flange portion of spouts from both sides and guide said spouts into a single row, a feed-in means disposed near an exit of said spout supply rails, said feed-in means driving said spouts on said spout supply rails toward said cut and advancing said spouts in a state of tight contact with each other, an opening-and-closing stopper disposed at said exit of said spout supply rails so as to contact an leading spout and position said leading spout, and a separating stopper that engages with a second spout and stops an advance of said second spout when said opening-and-closing stopper is opened, and releases said engagement with said second spout when said opening-and-closing stopper is closed.

* * * * *